US010364399B2

(12) United States Patent
Braly et al.

(10) Patent No.: US 10,364,399 B2
(45) Date of Patent: Jul. 30, 2019

(54) HIGH OCTANE UNLEADED AVIATION FUEL

(71) Applicant: GENERAL AVIATION MODIFICATIONS, INC., Ada, OK (US)

(72) Inventors: George W Braly, Ada, OK (US); Alexander Henseler, Cologne (DE); Torsten F Hauschild, Bergisch Gladbach (DE); Timothy C Roehl, Ada, OK (US)

(73) Assignees: GENERAL AVIATION MODIFICATIONS, INC., Ada, OK (US); LANXESS DEUTCHLAND GmbH, Cologne (DE)

( * ) Notice: Subject to any disclaimer, the term of this patent is extended or adjusted under 35 U.S.C. 154(b) by 0 days.

(21) Appl. No.: 15/848,541

(22) Filed: Dec. 20, 2017

(65) Prior Publication Data

US 2019/0062658 A1 Feb. 28, 2019

Related U.S. Application Data

(63) Continuation-in-part of application No. 15/688,000, filed on Aug. 28, 2017.

(51) Int. Cl.
*C10L 1/223* (2006.01)

(52) U.S. Cl.
CPC ..... *C10L 1/223* (2013.01); *C10G 2300/1044* (2013.01); *C10G 2300/1051* (2013.01); *C10G 2400/08* (2013.01); *C10L 2270/04* (2013.01)

(58) Field of Classification Search
CPC combination set(s) only.
See application file for complete search history.

(56) References Cited

U.S. PATENT DOCUMENTS 1,495,501 A 5/1924 Taber
1,571,862 A 2/1926 Midgley, Jr.
(Continued)

FOREIGN PATENT DOCUMENTS

AU 2006351908 B2 3/2011
CA 2672211 6/2008
(Continued)

OTHER PUBLICATIONS

Davidson, Hanson, Interpreting Shock Tube Ignition Data, Paper 03F-61, Mechanical Engineering Department, WSSCI Fall 2003 Meeting, Oct. 20-21, 2003, University of California (24 pages).
(Continued)

*Primary Examiner* — Ellen M McAvoy
*Assistant Examiner* — Chantel L Graham
(74) *Attorney, Agent, or Firm* — R. Reams Goodloe, Jr.

(57) ABSTRACT

Method for manufacture of unleaded aviation gasoline. The method includes blending a high octane alkylate, an effective amount of selected alkyl benzenes and of selected aromatic amines to improve the functional engine performance to avoid harmful detonation sufficient to meet or exceed selected standards for detonation performance requirements in full scale aircraft piston spark ignition engines designed for use with Grade 100LL avgas. Suitable alkylated benzenes may include a mixture of xylene isomers. Selected aromatic amines, such as N-methyl-p-toluidine, may be added to increase MON. The high octane alkylate may be an aviation alkylate, or iso-octane, or both, and may utilize high octane alkylates having a motor octane number of between about ninety-seven (97) and about one hundred (100). Suitable amounts of iso-pentane, n-butane, and iso-butane may be used for providing vapor pressure in a commercially acceptable range.

39 Claims, 2 Drawing Sheets

Figure 1:
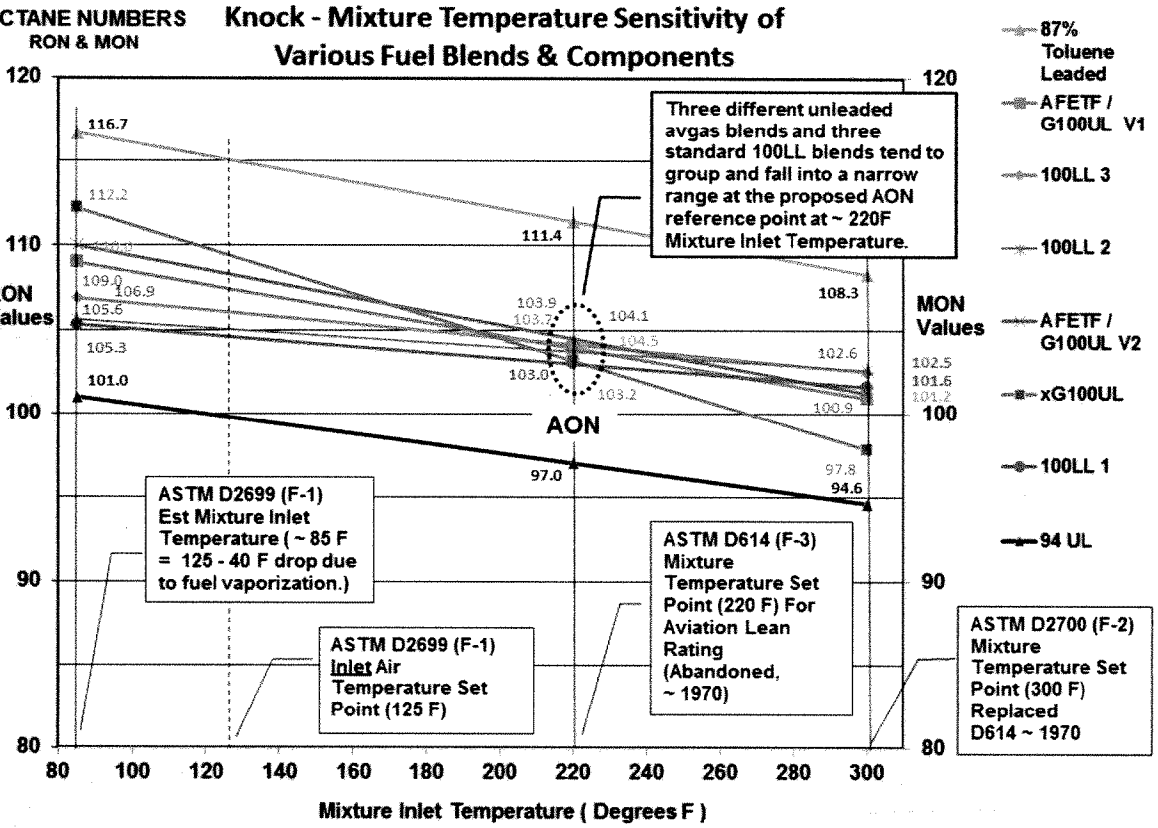

Copyright © 2017, by General Aviation Modifications, Inc.

(56) References Cited

U.S. PATENT DOCUMENTS

| | | | |
|---|---|---|---|
| 1,592,953 | A | 7/1926 | Midgley, Jr. |
| 1,605,663 | A | 11/1926 | Kettering et al. |
| 1,606,431 | A | 11/1926 | Hamby |
| 1,713,589 | A | 5/1929 | Bereslavsky |
| 1,741,032 | A | 12/1929 | Minter |
| 1,844,362 | A | 2/1932 | Ihrig |
| 2,394,180 | A | 2/1946 | Imm |
| 2,398,197 | A | 4/1946 | Stanly |
| 2,409,156 | A | 10/1946 | Schulze et al. |
| 2,410,846 | A | 11/1946 | Walters |
| 2,413,262 | A | 12/1946 | Stirton |
| 2,476,315 | A | 7/1949 | Morrison |
| 2,560,602 | A | 7/1951 | Schulze |
| 2,637,635 | A | 5/1953 | McLaughlin |
| 2,917,561 | A | 12/1959 | Eby |
| 3,069,470 | A | 12/1962 | Fleck |
| 3,212,867 | A | 10/1965 | Ockerbloom |
| 3,267,165 | A | 8/1966 | Kimble |
| 4,010,358 | A | 3/1977 | Morris |
| 4,266,947 | A | 5/1981 | Hartle et al. |
| 4,294,587 | A | 10/1981 | Burns |
| 4,331,024 | A | 5/1982 | Childs et al. |
| 4,408,585 | A | 10/1983 | Stuckas |
| 4,452,207 | A | 6/1984 | Moore, Jr. |
| 4,480,129 | A | 10/1984 | Priegnitz et al. |
| 4,695,292 | A | 9/1987 | Osborg |
| 4,897,087 | A | 1/1990 | Blain et al. |
| 5,087,781 | A | 2/1992 | Schutz et al. |
| 5,125,235 | A | 6/1992 | Yanagihara et al. |
| 5,284,984 | A | 2/1994 | Dessau et al. |
| H1305 | H | 5/1994 | Townsend et al. |
| 5,385,588 | A | 1/1995 | Brennan et al. |
| 5,470,358 | A | 11/1995 | Gaughan |
| 5,653,866 | A | 8/1997 | Jessup et al. |
| 5,851,241 | A | 12/1998 | Studzinski et al. |
| 5,891,202 | A | 4/1999 | Barratt et al. |
| 5,925,152 | A | 7/1999 | Barratt et al. |
| 5,941,222 | A | 8/1999 | Braly |
| 5,948,126 | A | 9/1999 | Barratt et al. |
| 5,962,775 | A | 10/1999 | Liiva et al. |
| 5,978,728 | A | 11/1999 | Fontana et al. |
| 6,187,064 | B1 | 2/2001 | Henderson |
| 6,238,446 | B1 | 5/2001 | Henderson |
| 6,258,134 | B1 | 7/2001 | Studzinski |
| 6,297,417 | B1 | 10/2001 | Samson et al. |
| 6,411,886 | B1 | 6/2002 | Morra et al. |
| 6,451,075 | B1 | 9/2002 | Schoppe et al. |
| 6,565,617 | B2 | 5/2003 | Kalghatgi |
| 6,767,372 | B2 | 7/2004 | Barnes et al. |
| 6,858,048 | B1 | 2/2005 | Jimeson et al. |
| 7,039,518 | B2 | 5/2006 | Ingram et al. |
| 7,416,568 | B2 | 8/2008 | Clark |
| 7,462,207 | B2 | 12/2008 | Clark |
| 7,553,404 | B2 | 6/2009 | Clark et al. |
| 7,740,668 | B2 | 6/2010 | Gaughan |
| 7,833,295 | B2 | 11/2010 | Clark |
| 7,862,629 | B2 | 1/2011 | Gaughan et al. |
| 7,897,034 | B2 | 3/2011 | De Oliveira et al. |
| 8,049,048 | B2 | 11/2011 | Rusek et al. |
| 8,232,437 | B2 | 7/2012 | Clark et al. |
| 8,628,594 | B1 | 1/2014 | Braly |
| 2002/0005008 | A1 | 1/2002 | Studzinski et al. |
| 2002/0045785 | A1 | 4/2002 | Bazzani et al. |
| 2002/0055663 | A1 | 5/2002 | Barnes et al. |
| 2002/0166283 | A1 | 11/2002 | Kalghatgi |
| 2003/0000131 | A1 | 1/2003 | Henry et al. |
| 2003/0040650 | A1 | 2/2003 | Butler et al. |
| 2003/0183554 | A1 | 10/2003 | Bazzani et al. |
| 2004/0124122 | A1 | 7/2004 | Clark |
| 2005/0044778 | A1 | 3/2005 | Orr |
| 2005/0144834 | A1 | 7/2005 | Jimeson et al. |
| 2005/0229480 | A1 | 10/2005 | Gaughan et al. |
| 2006/0052650 | A1 | 3/2006 | Thebault et al. |
| 2006/0086040 | A1 | 4/2006 | De Oliveira et al. |
| 2006/0123696 | A1 | 6/2006 | Gaughan et al. |
| 2006/0225340 | A1 | 10/2006 | Gaughan et al. |
| 2006/0288635 | A1 | 12/2006 | Seyfried |
| 2007/0033859 | A1 | 2/2007 | Ketley et al. |
| 2007/0215519 | A1 | 9/2007 | Dierickx et al. |
| 2008/0134571 | A1 | 6/2008 | Landschof et al. |
| 2008/0168706 | A1 | 7/2008 | Rusek et al. |
| 2008/0172931 | A1 | 7/2008 | Bazzani et al. |
| 2008/0178519 | A1 | 7/2008 | Bazzani et al. |
| 2008/0244961 | A1 | 10/2008 | Rusek et al. |
| 2008/0244963 | A1 | 10/2008 | Demoment et al. |
| 2008/0289250 | A1 | 11/2008 | Bazzani et al. |
| 2008/0295388 | A1 | 12/2008 | Bazzani et al. |
| 2009/0013589 | A1 | 1/2009 | Aradi et al. |
| 2009/0229172 | A1 | 9/2009 | Brady et al. |
| 2009/0229173 | A1 | 9/2009 | Gosling |
| 2010/0018112 | A1 | 1/2010 | Russo et al. |
| 2010/0263262 | A1 | 10/2010 | Gaughan |
| 2012/0029251 | A1 | 2/2012 | Hemighaus et al. |
| 2012/0080000 | A1 | 4/2012 | Landschof et al. |
| 2012/0279113 | A1 | 11/2012 | Landschof et al. |
| 2014/0123548 | A1* | 5/2014 | Braly ..... C10L 1/14 44/426 |
| 2014/0128644 | A1 | 5/2014 | Braly |
| 2014/0202069 | A1* | 7/2014 | Aradi ..... C10L 1/14 44/359 |

FOREIGN PATENT DOCUMENTS

| | | | |
|---|---|---|---|
| EP | 1650289 | A1 | 4/2006 |
| EP | 1611224 | B1 | 5/2010 |
| EP | 2537913 | A1 | 12/2012 |
| WO | WO 97/44413 | | 11/1997 |
| WO | WO 98/22556 | | 5/1998 |
| WO | WO 99/49003 | | 9/1999 |
| WO | WO 02/22766 | A1 | 3/2002 |
| WO | WO 2005/100513 | A2 | 10/2005 |
| WO | WO 2006/026657 | A3 | 3/2006 |
| WO | WO 2006/060364 | A3 | 8/2006 |
| WO | WO 2007/074226 | A1 | 7/2007 |
| WO | WO 2008/013922 | A1 | 1/2008 |
| WO | WO 2008/073118 | A1 | 6/2008 |
| WO | WO 2009/152495 | A2 | 12/2009 |
| WO | WO 2009/152495 | A3 | 12/2009 |
| WO | WO 2010/004395 | A1 | 1/2010 |
| WO | WO 2011/035219 | A2 | 3/2011 |
| WO | WO 2011/035219 | A3 | 3/2011 |
| WO | WO2011/109575 | A2 | 9/2011 |
| WO | WO2011/109575 | A3 | 9/2011 |

OTHER PUBLICATIONS

Cummings, H.K., Detonation Rating of Aviation Fuels, 1st World Petroleum Congress, Jul. 18-24, 1933, London, UK, (13 pages).

AVGAS Review-AFC 2007, Alisdair Clark; Clark Aviation Fuels Committee, AFC Mar. 21, 2007 (27 pages).

Executive Summary, CRC Research Results, Unleaded High Octane Aviation Gasoline, A Report to the CRC Unleaded AVGTAS Development Panel, Apr. 24, 2008 (9 pages).

Atwood, David, Full-Scale Engine Detonation, Tests of 47 Unleaded, High-Octane Blends, Sep. 2008, Final Report, DOT/FAA/AR-08/40 (287 pages).

Atwood, David, Full-Scale Engine Knock Tests of 30 Unleaded, High-Octane Blends, Sep. 2004, Final Report, DOT/FAA/AR-04-25 (314 pages).

Pye, Barton, Knock-Rating: Motor Gasoline and Aviation Gasoline, 1st World Petroleum Congress, Jul. 18-24, 1933, London, (6 pages).

Evans, Garner, The Knock-Ratings of Gasolines and Their Chemical Composition, 2nd World Petroleum Congress, Jun. 14-19, 1937, Paris, France, (7 pages).

Heron, Gillig, Supercharged Knock Testing, 2nd World Petroleum Congress, Jun. 14-19, 1937, Paris, France, (11 pages).

Hofman, Lapeyrouse, Sweeney, New Blending Agents for Aviation Gasoline of 100 Octane Number, 2nd World Petroleum Congress, Jun. 14-19, 1937, Paris, France, (8 pages).

Grebenshchikov, Influence of Gasoline Distillation Curve on Carburetor Icing, Journal Article, UDC 665.733.033.542.488, All-

(56) References Cited

OTHER PUBLICATIONS

Union Scientific-Research Institute for Petroleum Processing (1981) (4 pages).
Persson, Hjelmco Oil AB, Presentation—Future fuels of aviation IAOPA WA, Toronto, 2006, Sweden (33 pages).
Hjelmberg, Hjelmco Oil AB, Presentation—Future fuels of aviation, Vasteras, Jan. 23, 2007 (33 pages).
Hjelmberg, Hjelmco Oil AB, Presentation—23 years of experience with Unleaded AVGAS in Sweden, (2004) (34 pages).
Hjelmco Oil, The Unleaded Aviation Gasoline With Improved Environmental Qualities, (AVGAS 91/96 UL), Edition: V. (Oct. 17, 1997) (22 pages).
Atwood, David, Full-Scale Engine Detonation and Power Performance Evaluation of Swift Enterprises 702 Fuel, Jan. 2009 Final Report, DOT/FAA/AR-08/53 (181 pages).
Research Results Unleaded High Octane Aviation Gasoline, Final Report, CRC Project No. AV-7-07, Jun. 2010 (298 pages).
Chevron, Aviation Fuels Technical Review, 2006 (96 pages).
Sakrison, Article, EAA Air Venture, Standards Sough for Unleaded Aviation Fuel, Aug. 1, 2008 (7 pages).
Department of the Navy, Advance Notice of Proposed Rulemaking on Lead Emissions from Piston-Engine Aircraft Using Leaded Aviation Gasoline, 75 FR 22440, Oct. 24, 2010, (3 pages).
Bailey, Bunker, USSAF Europe WWII 100/150 Gradefuel, Sep. 1944 (10 pages).
Barnett, Report 1026, NACA Investigation of Fuel Performance in Piston-Type Engines (1951) (194 pages).
Sparrow, Report No. 232, Fuels for High-Compression Engines, NACA Report (1926) (20 pages).
Evaluation of Reciprocating Aircraft Engines with Unleaded Fuels, Dec. 1999, Final Report, DOT/FAA/AR-99/70 (82 pages).
Charnes, Cooper, Mellon, Econometrica, Journal of the Econometric Society, Blending Aviation Gasolines, A Study in Programming Interdependent Activities in an Integrated Oil Company, Accessed: 17:18 (Apr. 1952) (26 pages).
Johnston, Farrell, Laminar burning velocities and Markstein lengths of aromatics at elevated temperature and pressure, Proceedings of the Combustion Institute, 30 (2005) 217-224 (8 pages).
Executive Summary, CRC Research Results, Toward Development of an Unleaded High Octane Aviation Gasoline, A Report to the CRC Unleaded AVGAS Development Group, Apr. 1, 2003 (6 pages).
CRC Unleaded AVGAS Development Group Meeting, May 1, 2006, Alexandria, Virginia (8 pages).
Speight, The Chemistry and Technology of Petroleum, $4^{th}$ Edition, CRC Press, Copyright, 2007 (p. 745) (1 page).
Atwood, David, Full-Scale Engine Endurance Test of Swift Enterprises UL 102 Fuel, Jul. 2010, Final Report, DOT/FAA/AR-10/13 (70 pages).
Swift Enterprises, Presentation, Swift Sustainable Aviation Fuels, A High Octane Alternative to 100LL, EAA Airventure, Jul. 30, 2009 (28 pages).
Simpson, Martin J., The Douglas A/B -26 Invader, Fuel, (date unknown) (16 pages).
Millner, Paul, AVGAS 2020: The Future Fuel, Jun. 2006 (7 pages).
Atwood, David, High-Octane and Mid-Octane Detonation Performance of Leaded and Unleaded Fuels in Naturally Aspirated, Piston, Spark Ignition Aircraft Engines, Mar. 2007, Report, DOT/FAA/AR-TN07/5 (48 pages).
Desrosier, Presentation, Beyond 100LL, Next Steps in Addressing Leaded Aviation Gasoline, General Aviation Manufacturers Association (GAMA), GA AVGAS Coalition- 2011 ACI NA Environmental Affairs Conference, Jun. 27, 2011 (28 pages).
Ziulkowski, Collective Knowledge on Aviation Gasolines, Purdeu e-Pubs, Jul. 10, 2011 (213 pages).
Rumizen, Aviation Gasoline, Status and Future Prospects, Presentation, 34th Annual FAA Forecast Conference, Apr. 1, 2009 (9 pages).
Orr, Fuel-ish Questions, Fuel-ish Answers, FAA Aviation News, Jul./Aug. 2009 (4 pages).
Waxman, Letter to Michael P. Huerta, FAA, Oct. 23, 2012 (2 pages).
Midgley, Shell, Presentation, AVGAS Octane, Is Motor Octane Number the Whole Story? AFC, Mar. 2010 (18 pages).
Winkle, Aviation Gasoline Manufacture, (1944), Production of Finished Aviation Gasolines, Chapter II cover pages (3 pages) and (pp. 182-183; 191-200).
Ells, AVGAS Alternatives, Feb. 2011, Flyingmag.com (3 pages).
FAA Aviation Safety, Special Airworthiness Information Bulletin, SAIB: NE-11-55, Sep. 14, 2011, Subject: Grade 100VLL Aviation Gasoline, (2 pages).
Kelly, Richard L., National Advisory Committee for Aeronautics, Wartime Report, Issued Nov. 1944 as Memorandum Report E4K17, The Low-Temperature Solubility of 24 Aromatic Amines in Aviation Gasoline, Aircraft Engine Research Laboratory, Cleveland, Ohio, NACA, Washington (E-164) (13 pages).
Kelly, Richard L., National Advisory Committee for Aeronautics, Wartime Report, Issued Nov. 1945 as Memorandum Report E5K09, The Low-Temperature Solubility of 42 Aromatic Amines in Aviation Gasoline, Aircraft Engine Research Laboratory, Cleveland, Ohio, NACA, Washington (E-167) (15 pages).
Apr. 25, 2014—PCT International Search Report with Written Opinion of International Searching Authority for PCT/US2014/011330 (Transmittal + 18 pages).
Sep. 25, 2015—PCT International Preliminary Report on Patentability, for PCT/US2014/011330 (Transmittal + 15 pages).
Brown, J.E. Mechanism of Aromatic Amine Antiknock Action. Industrial and Engineering Chemistry (Oct. 1955) vol. 47, No. 10, pp. 2141-2146 (6 pages).
Espacenet, European Patent Office. Bibliographic data: XP002539089 Brown, J.E. Mechanism of Aromatic Amine Antiknock Action. Industrial and Engineering Chemistry (Oct. 1955) vol. 47, No. 10, pp. 2141-2146. (1 page).
Jul. 25, 2016—Search Report and Written Opinion (European Patent Office) EP16154197 (6 pages).
Freyermuth, George H. 1945-04-00—Super Fuel for Aircraft (5 pages).
https://www.chemicalbook.com/ProductChemicalPropertiesCB2681115_EN.htm (downloaded on Jan. 7, 2019) (2 page).
Wikipedia—Toluidine (https://en.wikipedia.org/wiki/Toluidine) (2 pages), 2019.

* cited by examiner

Copyright © 2017, by General Aviation Modifications, Inc.

Copyright © 2017, by General Aviation Modifications, Inc.

HIGH OCTANE UNLEADED AVIATION FUEL

CROSS REFERENCE TO RELATED APPLICATIONS

This application is a continuation-in-part of prior and co-pending U.S. patent application Ser. No. 15/688,000 filed Aug. 28, 2017, the disclosure of which is incorporated herein by this reference in its entirety, including the specification, drawing, claims, and abstract thereof.

STATEMENT OF GOVERNMENT INTEREST

Not Applicable.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

TECHNICAL FIELD

The present invention relates to fuels for spark ignition piston engines which may be used in general aviation or other aircraft, and more particularly, to high octane fuel blends formulated without lead additives.

BACKGROUND

The existing fleet of general aviation spark ignition piston engines, as well as new engines currently being delivered, and engines which are overhauled for use as replacements on existing aircraft, now typically operate using leaded fuels, as allowed in the United States under an exemption provided by the 1990 Federal Clean Air Act Amendments. As that Act banned the use of leaded fuels for over-the-road vehicles in the United States, general aviation aircraft engines have become an increasingly visible source of atmospheric lead emissions. Local legal action, such as in the State of California, or threatened environmental regulations, have increased scrutiny on the use of aviation gasolines (AVGAS) containing lead, and have thus spurred investigators into seeking viable high octane unleaded aviation fuels.

Most of the general aviation spark ignition piston engines in use today have been certified in the United States by the Federal Aviation Administration (FAA) for use with leaded aviation gasoline blends that meet the American National Standard No. ASTM D910-11 entitled Standard Specification for Aviation Gasolines. Under that standard, for Grade 100 fuel, 1.12 grams of lead per liter are provided in the fuel blend. In the most commonly used fuel, Grade 100LL, known as a "low lead" fuel, 0.56 grams of lead per liter are provided in the fuel blend. Both of those blends provide a minimum "knock value" lean mixture octane number of 99.6 per the ASTM D2700 Test Method. Also, both of those blends provide a minimum "knock value" rich mixture octane number of 130, per the ASTM D909 Test Method.

In the United States, the Federal Aviation Administration has been instrumental in conducting tests on various heretofore proposed formulations for low lead or no lead aviation gasoline. Their reports are publicly available through the US National Technical Information Service (NTIS), Springfield, Va. 22161. Such studies include the following reports:

(1) DOT/FAA/AR-04/25, entitled Full-Scale Engine Knock Tests of 30 Unleaded, High-Octane Blends, by David Atwood and Julian Canizales, issued by the Office of Aviation Research, Washington, D.C., in September 2004;

(2) DOT/FAA/AR-TN07/5, entitled High-Octane and Mid-Octane Detonation Performance of Leaded and Unleaded Fuels in Naturally Aspirated, Piston Spark Ignition Aircraft Engines, by David Atwood, issued by the U.S. Department of Transportation, Federal Aviation Administration, in March 2007;

(3) DOT/FAA/AR-08/40, entitled Full-Scale Engine Detonation Tests of 47 Unleaded High Octane Blends, by David Atwood, issued by the Office of Aviation Research, Washington, D.C., in September 2008; and (4) DOT/FAA/AR-08/53, entitled Full-Scale Detonation and Power Performance Evaluation of Swift Enterprises 702 Fuel, by David Atwood, issued by the Office of Aviation Research, Washington, D.C., in January 2009.

The September 2004 FAA report describes how over 200 blends of potential future aviation unleaded fuels were considered. Thirty of those blends, ranging in motor octane number (MON) from 96.2 to 105.6 were sufficiently promising to be blended into batches and knock-tested (as determined by ASTM D2700 standard) in a Lycoming 10-540-K aircraft engine at the FAA William J. Hughes Technical Center in Atlantic City, N.J. Components of such blends included ranges of some (or of all) of various ingredients, including super alkylate, toluene, ethyl tertiary butyl ether, meta-toluidine, ethanol, and methylcyclopentiadienyl manganese tricarbonyl (MMT), which were blended into a base fuel of either aviation alkylate or motor alkylate. In various cases, the FAA researcher reported that the performance of many of the tested blends deviated from that suggested by either their MON or by their performance number (PN).

The March 2007 FAA report compared detonation performance of mid and high octane leaded and unleaded fuels. The fuels were compared at the onset of light detonation. The fuels were tested in a naturally aspirated Lycoming 10-540-K engine and in a naturally aspirated Lycoming IO-320-B engine. For testing, the motor octane number (MON) of fuels was determined by ASTM International (ASTM) specification D2700. The supercharge rich rating was determined by the ASTM D909 standard. In general, the testing showed that the Grade 100LL fuel (with values minimally meeting the MON and Supercharge Rating of ASTM D910-11) significantly outperformed the matrix of tested unleaded fuels of equivalent MON, including even those with much higher ASTM Standard D909 supercharge rich ratings, particularly as seen when operated on full scale aircraft engines rather than the laboratory test engines used to establish the ASTM Standard D2700 MON and the D909 rich rating performance number (PN). The March 2007 report indicates that the supercharge rich ratings do not appear to have the same significance for the matrix of unleaded fuels that were tested as they do for leaded hydrocarbon fuels. Based on the blends tested, the report clearly suggests that development of a better detonation performance unleaded aviation fuel would be desirable.

The September 2008 FAA report was a continuation of the research described in the September 2004 report. Based on the results of the 30 potential future aviation unleaded fuel blends earlier tested, another matrix of 47 unleaded fuel blends was developed and detonation tested in a Lycoming 10-540-K aircraft engine at the FAA William J. Hughes Technical Center in Atlantic City, N.J. Components of such blends included varying ranges of "high octane components" such as aviation alkylate, super alkylate, toluene, ethyl tertiary butyl ether (ETBE), meta-toluidine, tert-butylbenzene. The blends contained iso-pentane for volatility control. Comprehensive blend formulations, by both volume fractions and mass fractions of those fuel blends were reported in Tables 2, 3, 4, and 5 of that report. The blends with a target range of 97.6 to 106.3 MON were tested against a baseline leaded reference fuel that met all specifications of ASTM D910 for Grade 100LL fuel with minimum MON and minimum performance number (PN) per ASTM D909. The blends were also tested against a 100LL aircraft fuel purchased at the local airport. In that testing, the FAA researcher reported that none of the unleaded blends of equivalent or lower MON performed as well as the Grade 100LL fuel in the detonation tests, particularly as seen when operated on full scale engines rather than the laboratory test engines used to establish the ASTM D2700 MON and the ASTM D909 rich rating performance number (PN). It was also demonstrated that increased fuel flow of the unleaded blends was required above the fuel flow required for 100LL in order to achieve equivalent detonation performance. In short, the tested blends provided less detonation protection than leaded formulations of equivalent MON, and appeared to potentially be less efficient. Notably, the researcher again reported that using only motor octane number (MON) based on ASTM D2700 (for knock rating, lean mixture) to predict full scale engine performance of unleaded fuels, is inadequate.

The January 2009 report provides results of tests on a high octane, bio-fuel (fermentation based) composition identified as Swift 702 fuel, from Swift Enterprises of Indiana. Swift 702 fuel was separately reported by Swift Enterprises, Inc., assignee of U.S. Patent Application Publication No. 2008/0244961 A1, published on Oct. 9, 2008, as being eighty-three percent (83%) by weight of mesitylene (also known as, and hereinafter identified by the chemical name 1,3,5-trimethylbenzene), and seventeen percent (17%) by weight of iso-pentane. The FAA similarly reported that the Swift 702 fuel consisted of two pure chemical compounds. The Swift 702 fuel was reported by the FAA to have a motor octane number (MON) of 104.4, as determined by ASTM D2700. The Swift 702 fuel was detonation tested in a Lycoming 10-540-K aircraft engine used in the tests noted in the two reports above. Also, the Swift 702 fuel was tested in a turbocharged non-intercooled Lycoming TIO-540-J2BD aircraft engine. These two engines were reported by the FAA as having been previously determined as having the highest octane requirements of engines in the active general aviation fleet. The Swift 702 fuel provided slightly better detonation performance than Grade 100LL fuel that was purchased from the local airport aviation gasoline fixed base operator. However, such fuel deviated from the 50% distillation point by substantial margins from the long standing ASTM D910 specification. Such very large deviations from the 50% distillation point is known by those experienced in the field to cause problems with engine operability and starting and field reports demonstrate that special starting procedures would have to be developed and approved by the airframe and engine manufacturers for use of such fuel. Thus, it would be desirable that any replacement aviation fuel more closely (than the binary Swift 702 formulation) meet the presently existing ASTM minimum specifications with respect to the distillation characteristics, in order to minimize any operatability issues, including issues with starting of the engines. To closely approximate the existing ASTM minimum specifications for aviation gasolines, it would also be desirable or required to avoid use of a simple binary component fuel blend such as the Swift 702 fuel blend, as such blends have been found to present problems with carburetors, and with distribution, especially during cold weather conditions. And, it would be desirable to provide a replacement aviation fuel that minimizes the quantity of 1,3,5-trimethylbenzene that must be produced to provide sufficient unleaded fuel quantities to the aviation marketplace through a fuel such as the Swift 702 fuel blend, since that compound is not presently produced in commodity quantities required to adequately supply the fleet of general aviation aircraft engines and is likely to be more expensive, even in large scale production, than other potential unleaded aviation gasoline components.

In other work, U.S. Pat. No. 5,470,358, entitled Unleaded Aviation Gasoline, was issued Nov. 28, 1995 to Gaughan, and assigned to Exxon Research & Engineering Co.; the disclosure of that patent is incorporated herein in its entirety by this reference. The Gaughan patent discloses an unleaded aviation fuel that combines (a) an aviation gasoline base fuel having a motor octane number (MON) of 90-93, with (b) an amount of at least one aromatic amine as that is effective to boost the motor octane number (MON) of the base fuel to at least about 98. However, many high performance aircraft engines require better performing fuels, i.e. fuels that at least have the ability to run at all significant operating conditions in a manner substantially equivalent to that presently provided by at least a fuel that meets the minimum ASTM D910-11 specification for Grade 100LL, if not more. Thus, it would be desirable that a fuel provide actual detonation performance that meets or exceeds the performance provided by fuels meeting the minimum ASTM D910-11 specifications for Grade 100LL fuel. It would be even more desirable to provide a fuel that meets or exceeds—in full scale aircraft engine testing—the performance of an FBO Grade 100LL fuel.

U.S. Pat. No. 6,258,134 B1, entitled High Octane Unleaded Aviation Gasolines, issued Jul. 10, 2001 to Studzinski et al., and assigned to Texaco, Inc., discloses an unleaded aviation fuel of at least 94 motor octane number (MON). The disclosure of U.S. Pat. No. 6,258,134 B1 is incorporated herein in its entirety by this reference. In an embodiment, that disclosure provides an unleaded aviation fuel having a motor octane number (MON) of at least 94, made up of the combination of (1) an unleaded alkylate base fuel having a boiling point range that is substantially wider than the range of boiling points in aviation base fuel, and having a motor octane number (MON) of at least 91, (2) an alkyl tertiary butyl ether, and (3) an aromatic amine. Yet, high performance aircraft engines require better performing fuels. Further, it would be desirable to provide an unleaded aviation fuel that avoids the use of oxygenated components, such as alcohols or ethers, especially since use of the latter class of compounds has been eliminated by governmental regulation in many countries.

In Europe, Hjelmco Oil AB of Sweden has been selling unleaded avgas of various blends, including a 91/96 motor octane number (MON) unleaded blend that may be used in 91/96 and in 80/97 octane engines. See http://www.hjelmco.com. The 91/96 UL MON blend was first produced in Finland and introduced in 1991, and is now produced in Sweden. Hjelmco now reports on the above noted website that it is considering a Bio-alkylate derived avgas in a possible replacement for existing Grade 100LL avgas. However, in so far as is known, they do not yet offer a product that is capable of providing adequate detonation performance in aviation engines designed for use with 100 (MON)/130(PN) octane fuels, in spite of their many years of experience in blending and providing unleaded aviation fuels.

U.S. Pat. No. 6,767,372 B2, entitled Aviation Gasoline Containing Reduced Amounts of Tetraethyl Lead, issued Jul. 27, 2004 to Barnes et al, and assigned to Chevron U.S.A. Inc., discloses an unleaded aviation fuel of at least 94 motor octane number (MON). The disclosure of U.S. Pat. No. 6,767,372 B2 is incorporated herein in its entirety by this reference. In an embodiment, that disclosure provides an unleaded aviation fuel having, measured by volume, (a) about twenty percent (20%) to about eighty percent (80%) of iso-octane, (b) about five percent (5%) to about eighteen percent (18%) of toluene, (c) about one percent (1%) to about twenty percent (20%) of $C_4$ to $C_5$ paraffins, (d) greater than zero (0) to about one (1) ml of tetraethyl lead per gallon of the aviation gasoline composition, and (e) the balance of the composition being light alkylate produced in an alkylation unit using hydrogen fluoride or $H_2SO_4$ as a catalyst. In an embodiment, that aviation gasoline is described as being substantially free of ether compounds, such as methyl tertiary butyl ether (MTBE) or ethyl tertiary butyl ether (ETBE) or the like. However, the Barnes et al patent does not describe whether or not there is any possibility within the otherwise described ingredients to completely eliminate the use of tetraethyl lead. And, although it teaches reduced lead compositions in an aviation fuel, it does not provide specific suggestions as to possible formulations using the components described therein that might tend to further minimize or eliminate the use of tetraethyl lead in order to meet or exceed performance standards for presently existing for Grade 100LL aviation fuel.

Finally, U.S. Pat. No. 7,897,034 B2, entitled Aviation Gasoline Formulation, issued Mar. 1, 2011 to De Oliveira et al., and assigned to Petroleo Brasileiro S.A-Petrobras, discloses an unleaded aviation fuel of at least 94.4 motor octane number (MON). The disclosure of U.S. Pat. No. 7,897,034 B2 is incorporated herein in its entirety by this reference. In an embodiment, that disclosure provides an unleaded aviation fuel having, measured by volume, (a) between twelve percent (12%) to eighteen percent (18%) base alklyate, (b) between twenty-eight percent (28%) and forty-two percent (42%) super-alkylate, (c) between twenty percent (20%) and thirty percent (30%) toluene, (d) between three percent (3%) and five percent (5%) of a toluidine isomer blend, (e) between zero percent (0%) and five percent (5%) ethyl alcohol, and (f) between ten percent (10%) and twenty percent (20%) $C_5$ cut, and (g) between five percent (5%) and ten percent (10%) triptane, and wherein the super-alkylate is a distillation cut of the base alkylate containing between seventy-five percent (75%) and seventy-eight percent (78%) iso-octane. Although the De Oliveira et al. patent teaches reduction in required amounts of toluidines via increased use of triptane and super-alkylate, the formulation nevertheless includes the possibility of use of ethyl alcohol, which due to its affinity for water, has been generally found to be undesirable for aviation gasoline formulations, as mentioned in that patent itself.

Thus, in spite of the extensive testing and evaluation by the FAA and by others of various candidate unleaded aviation fuel blends, and other work as noted in the above described patent literature, there still remains an as yet unmet need for an unleaded aviation fuel blend that can be readily used in the existing general aviation piston engine aircraft fleet. Such a fuel, particularly a fuel that is essentially transparent in functionality to the aircraft engine during various flight operations as compared with existing Grade 100LL fuels, and which could be mixed in the aircraft fuel tank in a random manner with existing Grade 100LL fuel formulations, would provide significant benefits in the process of reduction and phase out of the use of existing lead containing aviation gasolines. That is because rather than requiring a simultaneous wholesale and widespread switch in aviation fuel availability, existing fuel systems could accommodate and provide a new unleaded aviation fuel as it becomes locally available from suppliers. And, aircraft crews would not need to be concerned with whether previously existing 100LL fuel or a new unleaded aviation fuel blend were available at any particular airfield. Further, it would be advantageous if a new unleaded aviation fuel were available that could be utilized with little or no mechanical alterations or replacements of existing aircraft engines or aircraft system adjustments, and which could be used with little or no additional certification or other regulatory changes that might impact the aircraft owner or operator. And, such a fuel would be of benefit to aircraft engine manufacturers and to aircraft manufacturing companies, as a fuel having such characteristics should enable them to avoid the need for extensive redesigns of equipment, testing, and recertification that might be required if an unleaded aviation fuel with less desirable performance characteristics were selected for widespread use. It would also be especially advantageous if in an embodiment, such a new unleaded aviation fuel, rather than having substantially less than existing energy content for use by the aircraft, would provide as much or more energy per unit volume of fuel tank capacity, i.e. British Thermal Units (BTU's) per gallon, as existing Grade 100LL fuels. In such a manner, it would be particularly advantageous if a new unleaded aviation fuel could be used to take full advantage of the existing mechanical design components with respect to mass flow of air into the engine, and materials of construction utilized in the fuel system, and be capable of operating without knock or detonation at rich and lean air fuel ratio conditions, with existing compression ratios, with full rated power output, in a stable and highly efficient manner in all flight operating conditions, including high power cruise conditions with lean air-fuel mixtures.

Moreover, it would be advantageous to provide a new aircraft fuel that may be produced and distributed as a substitute for, and in the same manner as, existing petroleum feedstock aircraft fuels, using existing refinery production systems, existing chemical industry production facilities, and fuel distribution systems, with it only being necessary to construct or slightly modify industrial facilities to produce any components that are not already in large scale production. It would be even more useful if such a replacement aircraft fuel were provided that provides detonation performance in full scale aircraft engines equivalent to 100LL fuels which meet the current ASTM D910-11 specification for detonation margins, or the previously used ASTM D614 standards, which, based on the work done to develop the aviation fuels disclosed herein, among other things, appears to more closely predict the performance of high octane aviation gasolines which include aromatics in their formulation. And, it would be desirable that such a new fuel blend falls within the range of the remaining and operationally significant ASTM D910-11 Table 1 requirements and the ASTM D6227 Table 1 requirements for aviation use of automotive gasoline. Extensive testing during the last 5 years has shown that there are a range of deviations from those requirements of a nature and an extent that are now known to not be operationally significant to the pilot or to the aircraft. One example is the successful history of the use of ASTM D6227 based 82UL) or similar automotive type fuels approved under FAA Supplemental Type Certifications, all while completely eliminating the use of lead additives in the fuel.

It would also be advantageous to accomplish such goals while providing, in an embodiment, a high octane unleaded aviation gasoline composition suitable for "drop-in" substitution, which is fully fungible with existing Grade 100LL aviation gasoline, in order to minimize the extent, complexity, and cost of any recertification efforts of the high performance, high-octane fuel powered engines found in existing general aviation aircraft. As used herein, the term "drop-in" substitution is directed to a fuel that meets aircraft engine performance and operational requirements and can be used transparently, from the operational standpoint (including fueling of and holding in the fuel tank, holding and processing in the fuel systems of an aircraft during storage and during operation, and consumed by combustion during operation of the aircraft engine, and producing environmentally acceptable products of combustion). In earlier industry discussions and writings on the subject of a potential replacement unleaded aviation gasoline, the term "quasi-drop-in" was used to describe such a fuel. More recently, the terminology has evolved and the term "drop-in" replacement is used to describe a fuel that is operationally transparent to the engine, the pilot, and the existing airport fuel supply infrastructure. Therefore, it would be helpful to the general aviation piston engine user community to have available a fuel which could be placed in the aircraft tanks and used without regard to changes in mechanical components or aircraft performance, and which minimizes or eliminates the need for regulatory paperwork. It would be advantageous if a new unleaded aviation fuel were available that meets such objectives, and that also can be used without material or operationally significant changes in existing operational manuals or procedures.

It would be extremely desirable that a fuel that is fully "fungible" with existing ASTM D910 100LL also be free of unacceptable characteristics, such as damaging the surface finish (paint) of the aircraft when accidentally spilled during refueling of the aircraft, and which does not have adverse effects on the components such as rubber or synthetic rubber fuel bladders.

SUMMARY

Exemplary high octane unleaded aviation fuel blends are described herein, as well as methods for preparation of the same. In an embodiment, such new unleaded aviation fuel blend may provide a drop-in substitution that should enable use of full rated power output from existing engines, in a manner equivalent to the power output obtained when using existing FBO Grade 100LL avgas blends. Further, in an embodiment, such a new unleaded aviation fuel blend should enable aircraft engine operation in a fuel efficient and economical manner.

In various embodiments, a novel high octane unleaded aviation gasoline composition is provided for use in piston engines. In an embodiment, a high octane unleaded aviation gasoline composition may include four basic groups of components. First, about forty-five percent (45%) to about sixty-five sixty-five percent (65%) by weight of an aviation alkylate, or commercially produced iso-octane, either of which are considered to fall within the more general term used herein, namely a selected high octane alkylate, since iso-octane is an alkylate. In various embodiments, the selected high octane alkylate may include an aviation alkylate having a motor octane number (MON) of between about 97 and about 99.9. In an embodiment, the selected high octane alkylate may be provided either exclusively or primarily be a commercial grade iso-octane, having a motor octane number (MON) of about 100. In various embodiments, such selected high octane alkylates may include a substantial or dominant portion of iso-octane, as well as other alkylates. In an embodiment, a suitable commercial grade iso-octane may be provided. In an embodiment, such a commercial grade iso-octane may have a motor octane number (MON) of at least 98, per the ASTM D2700 test procedure. In an embodiment, such a commercial grade iso-octane may have a motor octane number (MON) of about 100, per the ASTM D2700 test procedure. In an embodiment, such a commercial grade iso-octane may have a motor octane number (MON) of between about 98 and about 100, per the ASTM D2700 test procedure. In an embodiment, a suitable iso-octane may be provided as a commercial grade 2,2,4 trimethylpentane which is now readily available from existing facilities outside of the traditional oil refining facilities that have produced 100LL avgas by production of high grade alkylates in an alkylation unit. In either case, the selected high octane component is referred to herein as a selected "high octane alkylate."

Second, about ten percent (10%) to about thirty-five percent (35%) by weight of one or more alkalyated benzenes is provided.

Third, about six percent (6%) to about twelve percent (12%) by weight, collectively, of a selected composition of one or more of iso-pentane, n-butane, and iso-butane, are provided. In various embodiments, each of the one or more of iso-pentane, n-butane, and iso-butane may be provided in amounts that are sufficient that the high octane unleaded aviation gasoline composition has a vapor pressure of between 38 kPa and 49 kPa (between 5.51 pounds per square inch and 7.11 pounds per square inch). Such n-butane, iso-butane, and iso-pentane constituents are useful in providing desirable engine starting properties, especially in cooler or cold weather.

Fourth, octane enhancement is provided by utilization of about four percent (4%) to about fifteen percent (15%) by weight of one or more aromatic amine(s), and wherein the aromatic amine(s) include N-methyl-p-toluidine.

In various embodiments, a high octane unleaded aviation gasoline blend may further include an aromatic amine(s) composition that includes N-methyl-m-toluidine. In various embodiments, a high octane unleaded aviation gasoline blend may further include an aromatic amine(s) composition that includes m-toluidine, either with, or in the absence of, appreciable amounts of N-methyl-m-toluidine. In various embodiments, a high octane unleaded aviation gasoline may be provided wherein N-methyl-p-toluidine is present, and wherein the amount of N-methyl-p-toluidine and the amount of N-methyl-m-toluidine are present at the ratio of between about six to one (6:1) and ten to one (10:1), by weight. In an embodiment that optimizes use of both (N-methyl-m-toluidine and N-methyl-p-toluidine), based on methods of production thereof, the amount of N-methyl-p-toluidine and the amount of N-methyl-m-toluidine may be present at the ratio of about thirty-six to four (36:4), by weight.

In an embodiment that optimizes use of both (m-toluidine and N-methyl-p-toluidine), based on methods of production thereof, the amount of N-methyl-p-toluidine and the amount of m-toluidine may also be present at the ratio determined by the ratio of the production of the precursor molecule to N-methyl-p-toluidine (para-toluidine) and meta-toluidine. In various embodiments, a high octane unleaded aviation gasoline may be provided wherein N-methyl-p-toluidine is present, and wherein the amount of N-methyl-p-toluidine and the amount of N-methyl-m-toluidine are present at the ratio of between about four to one (4:1) and about twelve to one (12:1), by weight. In an embodiment, a high octane unleaded aviation gasoline may be provided wherein the formulation optimizes use of both N-methyl-p-toluidine and m-toluidine, based on methods of production thereof, so that the amount of N-methyl-p-toluidine and the amount of m-toluidine are present at the ratio of from about six to one (6:1) to about ten to one (10:1), by weight.

In other embodiments, a high octane unleaded aviation gasoline may be provided wherein the formulation optimizes use of both N-methyl-p-toluidine and m-toluidine, so that the amount of N-methyl-p-toluidine and the amount of m-toluidine are present at the ratio of from about two to one (2:1) to about eleven to one (11:1), by weight.

In various embodiments the production of N-methyl-p-toluidine may result in various related compounds also being produced in small quantities. generally as reaction side products such as n,n-dimethyl-p-toluidine. However such related compounds, in small quantities (e.g., about five percent (5%) or thereabouts, or less, of the N-methyl-p-toluidine ingredient), may be incorporated into the overall fuel blend without compromising the functionality of the various fuel blends taught herein.

In various embodiments, a high octane unleaded aviation gasoline blend may include one or more monoalkylated benzenes, and in such an embodiment, toluene may be provided. In various embodiments, toluene may be provided at an amount in the range of from more than zero percent (0%) to about thirty percent (30%) by weight of the high octane unleaded aviation gasoline.

In various embodiments, a high octane unleaded aviation gasoline blend may include one or more dialkylated and/or trialkylated benzenes. In such embodiments, the one or more dialkylated benzenes may include m-xylene or p-xylene, or both. In some embodiments, the m-xylene and the p-xylene, when alone or together in combination, may be included in amounts of up to about thirty-five percent (35%) by weight (when added together) of the high octane unleaded aviation gasoline. In various embodiments, diaklylated benzenes may either be provided as substantially pure commercial components, or may be provided, in whole or in part, by way of a commercial xylol mixture. In an embodiment, one of the one or more alkylated benzenes may include 1,3,5-trimethylbenzene.

In various embodiments, the amounts of aromatic amine(s) and of alkylated benzenes may be varied according to availability and then prevailing raw materials costs, within the parameters noted herein, while still maintaining the performance requirements of the high octane unleaded aviation gasoline. Thus, the high octane unleaded aviation fuel compositions described herein provide flexibility to the fuel manufacturer, fuel wholesaler, fuel distributor, or fuel blender.

Additionally, it is an advantage of the fuel described herein, and a novel feature over various other proposed lead free aviation fuels, that the fuel blends described herein may be mixed in any ratio with conforming and currently available 100LL avgas, and the resulting fuel mixture continues to exhibit adequate performance and detonation margins in spark ignited piston driven aircraft engines. This feature is important because it enhances the practical implementation of the use of the presently described and claimed fuel in commercial use, especially during any transition period while the currently existing 100LL avgas is phased out during the time frame required for implementation of nationwide unleaded aviation gasoline fuel supply.

BRIEF DESCRIPTION OF THE DRAWING FIGURES

The utility of the product described herein and made by the method disclosed herein is illustrated in the accompanying drawing figures, in which:

FIG. 1 provides an indication of the expected detonation performance of various aviation gasoline compositions described herein, at a standardized reference point of an inlet air mixture temperature of 220° F. (104.4° C.).

Figure 2:
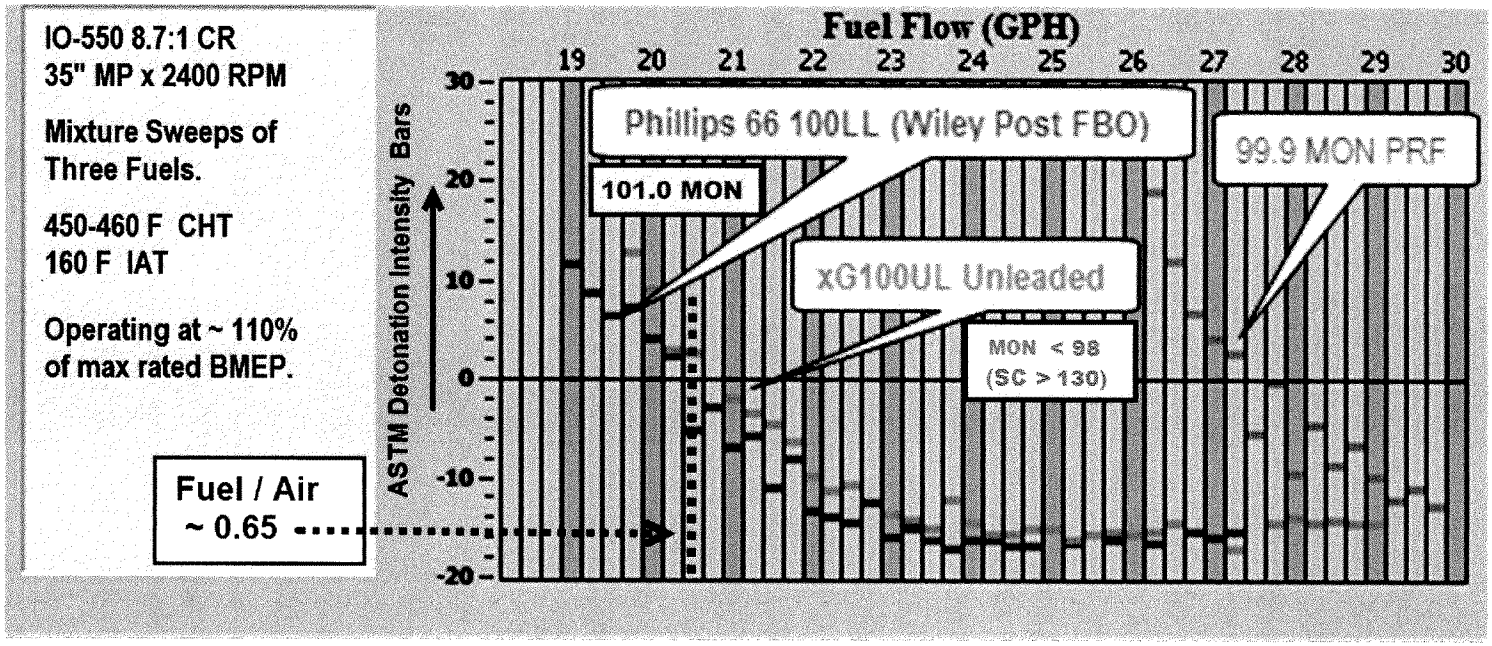

FIG. 2 graphically illustrates the results of full scale knock testing in a six (6) cylinder, five hundred fifty (550) cubic inch displacement spark ignition reciprocating aircraft piston engine operated at rich mixture and lean mixture test conditions.

The foregoing figures, being merely exemplary, contain various elements that may be present or omitted from various embodiments for compositions and methods that may be used to provide high octane unleaded aviation fuels as described herein. Consequently, various other constituents may be useful for manufacture of the advantageous high octane unleaded aviation fuels described herein, and for certain uses thereof, within the teachings hereof and within the coverage of the claims set forth herein.

DETAILED DESCRIPTION

Exemplary piston engine unleaded aviation fuel blends are set forth herein. Methods for the preparation of such novel unleaded aviation fuel blends, and methods for use of such novel unleaded fuel blend(s) as efficient "drop-in-substitutions" for existing aviation fuels (such as the leaded aviation Grade 100LL fuel) are also set forth herein.

As a result of testing of a novel unleaded aviation fuel blend candidates in a full scale aircraft engine test stand, as well as in a turbocharged aircraft in flight, it has now been discovered that it is possible to provide, in various embodiments, high octane unleaded aviation fuel blends by mixing (1) about forty-five percent (45%) to about sixty-five percent (65%) by weight of at least one high octane alkylate having a motor octane number (MON) of between about ninety-seven (97) and about one hundred (100);

(2) about ten percent (10%) to about thirty-five percent (35%) by weight of one or more alkalyated benzenes, and in various embodiments, dialkylated benzenes including methylbenzenes having at least some methyl groups in the meta-ring position (for example, 1,3-dimethybenzene, and 1,3,5-trimethylbenzene);

(3) about six percent (6%) to about twelve percent (12%) by weight, collectively, of a selected composition of one or more of iso-pentane, n-butane, and iso-butane, using the one or more of iso-pentane, n-butane, and iso-butane in amounts that are sufficient that the high octane unleaded aviation gasoline composition has a vapor pressure of between 38 kPa and 49 kPa (between 5.51 pounds per square inch and 7.11 pounds per square inch); and (4) about four percent (4%) to about fifteen percent (15%) by weight of one or more aromatic amine(s), and wherein the aromatic amine(s) include N-methyl-p-toluidine.

In various chemical industries, o-toluidine is produced as a key ingredient for various agricultural chemical products. During production of o-toluidine, p-toluidine and m-toluidine are produced as byproducts. It has been discovered, through testing and development of a new way of calculating and predicting performance of high octane unleaded aviation fuels which include aromatic hydrocarbons (such as aromatic amines and alky benzenes), that p-toluidine may be advantageously utilized, by way of further manufacture and use of N-methyl-p-toluidine from p-toluidine, in the manufacture of high octane unleaded aviation fuels. In some embodiments, it may also be possible to utilize, by further similar manufacturing methods, N-methyl-m-toluidine in fuel blends, as obtained from the related isomer byproduct m-toluidine, which also results from o-toluidine manufacture.

In various embodiments a high octane unleaded aviation gasoline blend may further include an aromatic amine(s) composition that includes m-toluidine, either with, or in the absence of, appreciable amounts of N-methyl-m-toluidine. In various embodiments, a high octane unleaded aviation gasoline blend may further include an aromatic amine composition that includes N-methyl-p-toluidine. In various embodiments, a high octane unleaded aviation gasoline may be provided wherein the amount of N-methyl-p-toluidine and the amount of N-methyl-m-toluidine are present at the ratio of between about four to one (4:1) and twelve to one (12:1), by weight. In various embodiments, a high octane unleaded aviation gasoline may be provided wherein the amount of N-methyl-p-toluidine and the amount of N-methyl-m-toluidine are present at the ratio of between about six to one (6:1) and about ten to one (10:1), by weight. The actual ratio may, in an embodiment, be selected to reflect the utilization of these two compounds at a rate proportional to the production of their precursor molecules that result from the commercial manufacture in response to demand for o-toluidine in unrelated markets. In an embodiment for an aviation fuel blend that optimizes use of both N-methyl-p-toluidine and m-toluidine, for advantageous consumption based on a selected method of production thereof, the amount of N-methyl-p-toluidine and the amount of either m-toluidine or N-methyl-m-toluidine may be present at the ratio of about thirty-six to four (36:4), by weight. In an embodiment for an aviation fuel blend that optimizes use of both N-methyl-p-toluidine and either m-toluidine or N-methyl-m-toluidine, for advantageous consumption based on a selected method of production thereof, the amount of N-methyl-p-toluidine and the amount of either m-toluidine or N-methyl-m-toluidine may be present at the ratio of about nine to one (9:1), by weight.

Unfortunately, currently utilized aviation fuel test procedures for Motor Octane Number, namely the ASTM D2700 Test Method, while correctly providing an indication of the expected performance for paraffinic based fuels, does not provide a reliable indication of the expected performance of aromatic based fuels in actual aircraft engines, as was discovered through testing of various fuel blends in a full scale aircraft engine in a test stand.

Interestingly, the methods for testing the performance of aviation fuel blends has been changed over the years, without recognition that the changed testing procedures have not adequately accounted for, amongst other things, the sensitivity of various aviation fuel blends to the inlet air temperature set point utilized for testing. For example, various pre-1970 testing done for aviation octane performance and for FAA approved engine certification was conducted using a "Waukesha F-3" engine with the temperature of the mixed fuel and air at the inlet to the combustion chamber heated and set to 220° F. Previous to use of the "F-2" (MON) engine for aviation gasoline octane ratings), full scale engine testing was typically conducted at mixture temperatures of approximately 220° F. which was a value consistent with the octane rating derived from using the "F-3" aviation lean rating engine pursuant to ASTM D614. The common use of this same 220° F. value, or values close to that 220° F. value is reflected in various older NACA test reports. However, in spite of such historic test data, the current ASTM D2700 Test Method, using a "Waukesha F-2" engine, utilizes a 300° F. condition for fuel mixture inlet temperature. Recent testing clearly shows that there is a significant discrepancy between performance of aromatic fuels as predicted by the current ASTM D2700 Test Method and the performance of the same fuel blend as seen in a full scale aircraft engine. Our recent testing strongly supports the understanding that the observed discrepancy in laboratory and full scale engine detonation performance is primarily due to the difference in the set point for the inlet air temperature between the earlier "F-3" "aviation lean rating" method and the more recent replacement or substituted "F-2" MON test method. This recent discovery, for the first time, now explains, at least in part, the years of confounding results found in the related published literature, including over 10 years of test reports generated by the FAA's Technical Center. The earlier "F-3" aviation lean rating was the standard used for FAA certification for the vast majority of the engines now in the fleet of general aviation aircraft. Empirically, various testing entities have observed significant discrepancies between the results of MON values from ASTM D2700 based tests, when compared to the results obtained by running the same fuel in a full scale aircraft engine. However, the detonation testing methods used for such full scale engine comparisons of fuel detonation characteristics are not the same methods and mathematical algorithms that are used for laboratory determinations of motor octane number (MON). The methods more recently used for that full scale engine testing have inherent deficiencies such that high aromatic fuels may be falsely characterized for detonation performance. Among such defective methods are the Standard Practices described in ASTM D6424 and ASTM D6812. The use of other methods, such as that described by the Kistler Instrument Corporation document entitled "Knock Detection 920-349e" provides detonation test results for full scale aircraft engines that are more consistent with historic detonation testing of aircraft piston engines and such methods do not introduce bias in the measured detonation intensities as a result of different fuel chemistries, different fuel/air ratios, and different spark ignition timing, as is observed with the ASTM D6424 and D6812 methods.

After extensive testing of various candidate aviation fuels in a full scale aircraft engine, it was repeatedly observed that certain candidate high octane unleaded aircraft fuel blends, and particularly those blends which include one or more di-alklylated benzenes, perform much better in a full scale aircraft engine than might be anticipated given the motor octane number ("MON") that such fuels are reported to have, when determined by laboratory testing using standard ASTM testing procedures. Thus, a new procedure has been developed for prediction of performance of an aromatic based unleaded aviation fuel, which I have termed Aviation Octane Number—which throughout this disclosure may be abbreviated by the acronym "AON". The AON number for a fuel is thus used to describe the comparative detonation performance of a selected high octane unleaded aviation gasoline when that fuel blend is tested in a full scale aircraft engine, as against anticipated performance as predicted by laboratory testing using standard ASTM Test Method D2700 for paraffinic based aviation fuels. Thus, the AON of a selected high octane aromatic based unleaded aviation gasoline will be higher than reflected by the MON as determined by laboratory testing using the standard ASTM Test Method D2700, yet the AON more accurately reflects the performance that may be expected in a full scale aircraft engine. In some formulations, the AON of such an unleaded aircraft fuel is greater than the standard ASTM test MON of traditional 100LL aviation gasolines by one (1) or more points of octane.

Nevertheless, the basis which was used for calculating Aviation Octane Number remain the ASTM Test Methods familiar to those of skill in the art, namely, the ASTM D2700 Standard Test Method for Motor Octane Number (MON) of Spark-Ignition Engine Fuel, and the ASTM D2699 Standard Test Method for Research Octane Number (RON). Using such test data, it was determined that the Aviation Octane Number for aromatic based aviation fuels may be reliably calculated using the following equation:

$$AON=MON+0.37\ (RON-MON)$$

Set out in FIG. 1 are the results of testing of various fuels when their performance is characterized by use of the AON formulation, which provides an indication of the expected detonation performance of each of the fuels at a standardized reference point of an inlet air mixture temperature of 220° F. Such mixture inlet temperature of 220° F. or temperatures close to 220° F. has often been used in the past for testing aviation gasoline octane performance, as is widely reported in the literature, including the NACA reports from before, during and shortly after World War II. It has been found that three standard, commercially available Grade 100LL fuel blends (identified as (i) 100LL 1, (ii) 100LL 2, and (iii) 100LL 3), and two unleaded avgas blends, identified as (iv) G100UL(B1), (v) G100UL(B2), each including di-alkylated benzenes and m-toluidine, and three further unleaded avgas blends, described and claimed herein, (vi) xG100UL (B3), (vii) xG100UL (B4), and (viii) xG100UL(B5), all tend to group and fall into a useable data value range associated with the 220° F. mixture inlet temperature, when the test data is evaluated using my "AON" formulation. Based on testing in full scale aircraft engines, the AON value provides a reliable indication of the actual knock performance on a full scale aircraft engine which may be expected for any particular fuel blend, whether the blend is actually (1) a paraffinic based fuel, such as existing Grade 100LL, or (2) an aromatic based fuel, such as (a) formulations disclosed in prior U.S. Pat. No. 8,628,594 B1, issued on Jan. 14, 2014, entitled High Octane Unleaded Aviation Fuel (the disclosure of which is incorporated herein in its entirety by this reference), or (b) formulations for avgas fuel blends as described and claimed herein. Fuels with AON values in the range of 100.5 and above should be acceptable for the existing fleet of general aviation piston engines. Fuels with AON values in the range of 101.0 and above should be more acceptable for the existing fleet of general aviation piston engines. Fuels with AON values in the range of 101.5 and above should be even more acceptable for the existing fleet of general aviation piston engines. While higher AON values may not be necessary to assure adequate performance in the existing fleet of general aviation piston engines, those of skill in the art will recognize that as standard commercial practice with existing 100LL fuel sales, there is some "giveaway" of octane number since aviation gasoline is often sold which have MON values that exceed the actual minimum ASTM requirements, in order to provide some insurance factor in the distribution chain. It may be, but is yet to be determined, that with respect to the newly developed AON numbers, regulatory and or standard developers (e.g. ASTM) may similarly insist on establishing approved AON levels slightly in excess of levels shown by full scale engine testing to be adequate for safe general aviation piston engine performance.

With respect to the currently described and claimed fuel blend, set out in FIG. 2 are the results of full scale knock testing in a six (6) cylinder, five hundred fifty (550) cubic inch displacement spark ignition reciprocating aircraft piston engine operated at rich mixture and lean mixture test conditions. The engine was an 10-550, with a 8.7:1 compression ratio, which was operated at 35 inches of manifold pressure at 2400 RPM, at a 160° F. inlet air mixture temperature, and with cylinder head temperatures at 450° F. to 460° F. Those skilled in the art will recognize those conditions as very harsh full scale engine operating conditions. A fuel blend prepared as described and claimed herein, and when operated under those same harsh conditions, performed on par with a Grade 100LL fuel marketed by Phillips 66, which was obtained from a local fixed base operator. Yet, while the 100LL fuel had a MON of 101. The presently claimed fuel, identified in FIG. 2 as "xG100UL", actually only had a MON of 97.8 according to the presently utilized ASTM D2700 Test Method. However, the "xG100UL" fuel has an Aviation Octane Number—AON—of 103.2, and a RON of 112.2, which calculated data is entirely consistent with performance as confirmed by the full scale engine data. Thus, the unleaded aviation fuels described herein provide an unleaded aviation fuel which will enable existing aircraft piston engines to operate free from harmful detonation.

TABLE 1

| | xG100UL Fuel Blend Comparisons | | | | | | | | | |
|---|---|---|---|---|---|---|---|---|---|---|
| Component | xG100UL Blend 1 % by weight | xG100UL Blend 2 % by weight | xG100UL Blend 3 % by weight | xG100UL Blend 4 % by weight | xG100UL Blend 5 % by weight | xG100UL Blend 6 % by weight | xG1000UL Blend 7 % by weight | xG1000UL Blend 8 % by weight | xG100UL Blend 9 % by weight | xG100UL Blend 10 % by weight |
| alkylate | 53.6 | 42.4 | 51.5 | 50.8 | 50.6 | 51.4 | 54 | 53.2 | 50.5 | 51.3 |
| metaxylene | 0 | 0 | | | | | 25 | 24.7 | | |
| xylol | 25.4 | 37 | 22.6 | 22.2 | 16.8 | 17.2 | | | 19.5 | 22.8 |
| toluene | 0 | 0 | | | 9.8 | 10 | | | 9.8 | |
| isopentane | 6.9 | 8 | 9 | 8.9 | 10.2 | 10.4 | 8.5 | 7.7 | 8.6 | 8.7 |
| isobutane | 1.9 | 2 | 1.3 | 1.2 | 1.6 | | 1.5 | 1.4 | 1.4 | 1.3 |
| butane | 1.1 | 1 | 1.2 | 1.2 | | | 1 | 1.5 | | 1.5 |
| m-toluidine | 1.3 | 0 | | | 2.2 | | | 2 | 2.1 | 2.4 |

TABLE 1-continued

| Component | xG100UL Fuel Blend Comparisons | | | | | | | | | |
|---|---|---|---|---|---|---|---|---|---|---|
| | xG100UL Blend 1 % by weight | xG100UL Blend 2 % by weight | xG100UL Blend 3 % by weight | xG100UL Blend 4 % by weight | xG100UL Blend 5 % by weight | xG100UL Blend 6 % by weight | xG1000UL Blend 7 % by weight | xG1000UL Blend 8 % by weight | xG100UL Blend 9 % by weight | xG100UL Blend 10 % by weight |
| n-methyl-p-toluidine | 9.9 | 8.5 | 12.9 | 12.7 | 8.8 | 9 | 9 | 9.5 | 8 | 11.9 |
| n-methyl-m-toluidine | 0 | 1.1 | 1.5 | 1.5 | | | 1 | | | |
| dpa | 0 | 0 | | 1.5 | | 2 | | | | |
| Vulkanox BHT | 0 | 0 | | | | | 0.0016 | | | |
| RON | Est. 111 | Est 110 | 112.2 | 112.4 | 110.8 | 110.3 | 112.4 | 112.1 | 108.5 | |
| MON | 96.2 | 95 | 97.8 | 96.8 | 96.2 | 95.3 | 96.4 | 97.7 | 96.4 | |
| AON = MON + 0.37 × (RON − MON) | Est 101.7 | Est 100.6 | 103.16 | 102.60 | 101.63 | 100.88 | 102.35 | 103.06 | 100.90 | |

Attention is now directed to Table 1, which provides exemplary blend formulations for various embodiments of a high octane unleaded aviation gasoline as described and claimed herein. Overall, as shown in Table 1, based on various embodiments that have been prepared for evaluation, useful high octane unleaded aviation fuel blends may include:

(a) high octane alkylate between about forty-five percent (45%) to about sixty-five percent (65%) by weight;

(b) mono-alkylated benzenes in the form of toluene in amounts from between about five point zero (5.0) and about twenty point zero percent (20.0%) by weight, or alternately may not be provided at all (i.e., as low as zero percent (0%));

(c) di-alkylated benzenes, which may be provided by using a xylol mixture in amounts between about sixteen point eight percent (16.8%) to about twenty-five point four percent (25.4%) by weight, or alternately, in individual constituent form, such as by way of use of m-xylene, or by use of m-xylene and para-xylene at about twenty-five percent (25%) by weight, or alternately may not be provided at all (i.e., as low as zero percent (0%));

(d) between about eight point five percent (8.5%) and about twelve point nine percent (12.9%) of N-methyl-p-toluidine, by weight;

(e) a xylol mixture, which may be provided in amounts between about sixteen point eight percent (16.8%) to about twenty-five point four percent (25.4%) by weight, or alternately may not be provided at all (i.e., as low as zero percent (0%));

(f) m-toluidine, which may be provided in amounts between about one point three percent (1.3%) to about two point two (2.2%) by weight, or alternately may not be provided at all (i.e, as low as zero percent (0%));

(g) iso-pentane, which may be provided in amounts between about six point nine percent (6.9%) to about ten point four percent (10.4%), or alternately may not be provided at less than about six point nine (6.9%) percent;

(h) iso-butane, which may be provided in amounts between about one point two percent (1.0%) to about three point five percent (3.5%), or alternately may not be provided at all (i.e, as low as zero percent (0%));

(i) n-butane, which may be provided in amounts between about one percent (1%) to about three point five percent (3.5%), or alternately may not be provided at all (i.e, as low as zero percent (0%));

(j) it will be understood by those of skill in the art that in addition to the aforementioned primary constituents, such refined products, including a high octane alkylate, may typically include an assortment of other hydrocarbons in relatively minor concentrations, as resulting from conventional manufacturing operations; and (k) additional conventional fuel additives may also be provided in amounts known and accepted in the art, (for example, see ASTM D910-11, at section 6.3, which describes a variety of acceptable additives and allowable concentrations thereof, including antioxidants, icing inhibitors, and corrosion inhibitors, as will be known and understood by those of skill in the art without need for further details) without affecting the overall blend formulations as described above.

As an Example Blend 1, shown in Table 1, in an embodiment, it may be anticipated that a useful high octane unleaded aviation fuel blend will include:

(a) about fifty-three point six percent (53.6%) of an alkylate base fuel, by weight;

(b) a xylol mixture to provide di-alkyated benzenes, in an amount of twenty-five point four percent (25.4%) by weight;

(c) about nine point nine percent (9.9%) of N-methyl-p-toluidine, by weight;

(d) about one point three percent (1.3%) of m-toluidine, by weight;

(e) about six point nine percent (6.9%) of iso-pentane, by weight;

(f) about one point nine percent (1.9%) of iso-butane, by weight; and (g) about one point one percent (1.1%) of n-butane, by weight. This Blend 1 has a MON of ninety-six point two (96.2), an estimated RON of about one hundred and eleven (111), and an estimated AON of one-hundred and one point seven (101.7).

As an Example Blend 2, shown in Table 1, in an embodiment, it may be anticipated that a useful high octane unleaded aviation fuel blend will include:

(a) about fifty-two point eight percent (52.8%) of an alkylate base fuel, by weight;

(b) about twenty-three point two percent (23.2%) of toluene, by weight;

(c) about eleven point two percent (11.2%) of N-methyl-p-toluidine, by weight;

(d) about one point seven percent (1.7%) of N-methyl-m-toluidine, by weight;

(e) about eight point four percent (8.4%) of iso-pentane, by weight;

(f) about one point six percent (1.6%) of iso-butane, by weight; and (g) about one point two percent (1.2%) of n-butane, by weight. This Blend 2 has a MON of ninety-five point one (95.1), an estimated RON of about one hundred and ten (110), and an estimated AON of one-hundred point six (100.6).

As an Example Blend 3, shown in Table 1, in an embodiment, it may be anticipated that a useful high octane unleaded aviation fuel blend will include:

(a) about fifty-one point five percent (51.5%) of an alkylate base fuel, by weight;
(b) a xylol mixture to provide di-alkyated benzenes, in an amount of about twenty-two point six percent (22.6%) by weight;
(c) about twelve point nine percent (12.9%) of N-methyl-p-toluidine, by weight;
(d) about one point five percent (1.5%) of N-methyl-m-toluidine, by weight;
(e) about nine percent (9%) of iso-pentane, by weight;
(f) about one point three percent (1.3%) of iso-butane, by weight; and
(g) about one point two percent (1.2%) of n-butane, by weight.

This Blend 3 has a MON of ninety-seven point eight (97.8). However, it has a RON of one hundred twelve point two (112.2) and an AON of one hundred three point two (103.2).

As an Example Blend 4, shown in Table 1, in an embodiment, it may be anticipated that a useful high octane unleaded aviation fuel blend will include:

(a) about fifty point eight percent (50.8%) of an alkylate base fuel, by weight;
(b) a xylol mixture to provide di-alkyated benzenes, in an amount of twenty-two point two percent (22.2%) by weight;
(c) about twelve point seven percent (12.7%) of N-methyl-p-toluidine, by weight;
(d) about one point five percent (1.5%) of N-methyl-m-toluidine, by weight;
(e) about one point five percent (1.5%) of diphenyl amine, by weight;
(f) about eight point nine percent (8.9%) of iso-pentane, by weight;
(g) about one point two percent (1.2%) of iso-butane, by weight; and
(h) about one point two percent (1.2%) of n-butane, by weight.

This Blend 4 has a MON of ninety-six point eight (96.8). However, it has a RON of one hundred twelve point four (112.4) and an AON of one hundred two point six 102.6).

As an Example Blend 5, shown in Table 1, in an embodiment, it may be anticipated that a useful high octane unleaded aviation fuel blend will include:

(a) about fifty point six percent (50.6%) of an alkylate base fuel, by weight;
(b) a xylol mixture to provide di-alkyated benzenes, in an amount of sixteen point eight percent (16.8%) by weight;
(c) about nine point eight percent (9.8%) of toluene, by weight;
(d) about two point two percent (2.2%) of m-toluidine, by weight;
(e) about eight point eight percent (8.8%) of N-methyl-p-toluidine, by weight;
(f) about ten point two percent (10.2%) of iso-pentane, by weight; and
(g) about one point six percent (1.6%) of iso-butane, by weight This Blend 5 has a MON of ninety-six point two (96.2). However, it has a RON of one hundred ten point eight (110.8) and an AON of one hundred one point six (101.6).

As an Example Blend 6, shown in Table 1, in an embodiment, it may be anticipated that a useful high octane unleaded aviation fuel blend will include:

(a) about fifty-one point four percent (51.4%) of an alkylate base fuel, by weight;
(b) a xylol mixture to provide di-alkyated benzenes, in an amount of seventeen point two percent (17.2%) by weight;
(c) about ten percent (10%) of toluene, by weight;
(d) about nine percent (9%) of N-methyl-p-toluidine, by weight;
(e) about two percent (2%) of diphenyl amine, by weight; and
(f) about ten point four percent (10.4%) of iso-pentane, by weight.

Note that although iso-butane, and n-butane were not included (as tested), for any commercial product, the vapor pressure provided by such components may necessate their presence, as generally described in the "Overall" blend formulations just set forth above. This Blend 6 has a MON of ninety-five point three (95.3). However, it has a RON of one hundred ten point three (110.3) and an AON of one hundred point nine (100.9).

As an Example Blend 7, shown in Table 1, in an embodiment, it may be anticipated that a useful high octane unleaded aviation fuel blend will include:

(a) about fifty-four percent (54%) of an alkylate base fuel, by weight;
(b) about twenty-five percent (25%) of m-xylene, by weight;
(c) about nine percent (9%) of N-methyl-p-toluidine, by weight;
(d) about one percent (1%) of N-methyl-m-toluidine, by weight;
(e) about eight point five percent (8.5%) of iso-pentane, by weight;
(f) about one point five percent (1.5%) of iso-butane, by weight; and
(g) about one percent (1%) of n-butane, by weight.

Blend 7 has a MON of ninety-six point four (96.4). However, it has a RON of one hundred twelve point four (112.4) and an AON of one hundred two point four (102.4).

As an Example Blend 8, shown in Table 1, in an embodiment, it may be anticipated that a useful high octane unleaded aviation fuel blend will include:

(a) about fifty-three point two (53.2%) of an alkylate base fuel, by weight;
(b) about twenty-four point seven percent (24.7%) of m-xylene, by weight;
(c) about nine point five percent (9.5%) of N-methyl-p-toluidine, by weight;
(d) about two percent (2%) of meta-toluidine, by weight;
(e) about seven point seven (7.7%) of iso-pentane, by weight;
(f) about one point four percent (1.4%) of iso-butane, by weight; and
(g) about one point five percent (1.5%) of n-butane, by weight.

This Blend 8 has a MON of ninety-seven point seven (97.7). However, it has a RON of one hundred twelve point one (112.1) and an AON of one hundred three point one (103.1).

As an Example Blend 9, shown in Table 1, in an embodiment, it may be anticipated that a useful high octane unleaded aviation fuel blend will include:

(a) about fifty point five (50.5%) of an alkylate base fuel, by weight;
(b) a xylol mixture to provide di-alkyated benzenes, in an amount of about nineteen point five (19.5%) of xylol, by weight;
(c) about nine point eight percent (9.8%) of toluene, by weight;
(d) about eight percent (8%) of N-methyl-p-toluidine, by weight;
(e) about two point one percent (2.1%) of meta-toluidine, by weight;
(f) about eight point six percent (8.6%) of iso-pentane, by weight;
(g) about one point four percent (1.4%) of iso-butane, by weight.

This Blend 9 has a MON of ninety-six point four (96.4). However, it has a RON of one hundred eight point five (108.5) and an AON of one hundred two point four (102.4).

As an Example Blend 10, shown in Table 1, in an embodiment, it may be anticipated that a useful high octane unleaded aviation fuel blend will include:

(a) about fifty-one point three (51.3%) of an alkylate base fuel, by weight;
(b) a xylol mixture to provide di-alkyated benzenes, in an amount of about twenty-two point eight (22.8%) of xylol, by weight;
(c) about eleven point nine percent (11.9%) of N-methyl-p-toluidine, by weight;
(d) about two point four percent (2.4%) of meta-toluidine, by weight;
(e) about eight point seven percent (8.7%) of iso-pentane, by weight;
(f) about one point three percent (1.3%) of iso-butane, by weigh
(g) about one point five percent (1.5%) of n-butane, by weight.

This Blend 10 was successfully tested on a full scale aircraft engine and passed all of the recently revised detonation test requirements established by the FAA for the certification of the unleaded high octane aviation gasoline described herein.

Thus, by testing the novel unleaded fuel blends described herein at load in an actual aircraft engine in a fully instrumented test stand, it was observed that, at least to some extent, the detonation performance on the full scale aircraft engine of certain novel unleaded aviation fuel blends exceeds the detonation performance which would be expected for such blends based on MON test results, or other existing test standards (e.g. the ASTM D2700 motor octane test required under ASTM Standard D910-11). Such beneficial effect, while unexpected based on MON data produced by such conventional testing, seems to especially manifest itself as demonstrated in full scale aircraft engine detonation performance testing in the case of novel unleaded aviation fuel blends which include alkylated benzenes having methyl groups in a meta and para-ring positions, and which include the use of N-methyl-p-toluidine.

By testing blends such as those described in Table 1, it has been determined that such blends will meet the FAA detonation certification requirements set forth in Part 33 of Title 14 of the Code of Federal Regulations and in related FAA Guidance Materials, for full power operation of a high compression aircraft piston engine at the limiting engine operating temperature parameters with a mixture setting that is more than 10% below the full rich mixture setting. My testing has also shown that fuels such as those described in Table 1 will also meet the full power detonation test requirements even when the engine horsepower is increased by more than 10% above its existing approved maximum power rating. My testing has established that the traditional rich rating as defined by the ASTM D909 test procedure is likely unnecessary, as the compositional nature of my new fuel assures that performance at full power and rich mixtures will be satisfactory.

Testing has further established that such blends as those described in Table 1 will also meet the typical requirements for detonation testing defined by the primary piston aircraft engine manufacturers at all other portions of the intended areas of engine operations, such as cruise power, with the cylinder head temperatures set to the maximum recommended continuous operating values for those operating conditions. Further, in our testing, it has been demonstrated that fuels such as those described in Table 1 will also meet the cruise power detonation requirements in a high compression aircraft piston engine when the engine cylinder head temperature and operating oil temperature are increased to values at or above the limits defined by FAA approved test plans for certification testing.

In various embodiments, a fuel blend may be provided that is suitable for use in an existing aircraft engine that was mechanically designed for combustion of a fuel having 99.6 motor octane number (MON) or better leaded aviation gasoline (e.g., Grade 100LL), where the engine utilizes a spark ignition system with pistons in cylinders. In such a method, a high octane unleaded aviation fuel blend may be provided according to one of the examples set forth above or as otherwise more broadly described herein, as a drop-in substitute for a previously used leaded aviation gasoline. In various embodiments, the alkylated benzenes, and in particular, di-alkylated benzenes, may be utilized, along with use of a selected amount of N-methyl-p-toluidine, in amounts effective to increase the detonation performance, based on AON data calculated from blend specific MON and RON data gathered utilizing ASTM Test Methods, to a value of AON greater than 100. In various embodiments, the unleaded aviation fuel blends described above which have an Aviation Octane Number (AON) of at least 99.6 may be useful in a method of drop-in-substitution for use in an existing aircraft engine.

In various embodiments, the aviation fuel blends just described for use in the method of drop-in-substitution in an existing engine may include blends as set forth in any of the Examples above within the disclosed percentages of blend components, to provide a more specific blend formulation. Also, where necessary or required for assuring adequate Reid Vapor Pressure of a final unleaded aviation gasoline blend to meet applicable specifications or service conditions, fuels having iso-pentane, iso-butane, and/or n-butane may be utilized.

Attention is directed to Table 2, wherein a comparison of detailed requirements for current Grade 100LL (AVGAS), Grade 82UL (Auto Gas), and the novel aviation fuel blend described herein (designated in Table 2 as xG100UL), is provided. At this time, the various high octane unleaded aviation gasoline blends described herein as are anticipated to be observed in the general range between the noted requirements (other than detonation related requirements) for Grade 100LL Avgas, as set forth in ASTM Specification D910 and the range for ASTM D6227 automotive gasoline used successfully for many aircraft engines for many years. As described, with respect to MON itself, that parameter clearly underestimates the detonation performance of the fuels now proposed, when such fuels are in actual full scale aircraft engine service.

TABLE 2

Comparison of Various Requirements for 100LL (AVGAS) vs xG100UL (new AVGAS) vs 82UL (auto gas)

| | | ASTM D910 Grade100LL AVGAS | xG100UL New AVGAS | D6227 (82UL) Auto Gas For Aviation Use | ASTM Test Methods[B] |
|---|---|---|---|---|---|
| Octane Ratings | | | | | |
| Knock value, Motor Octane Number | min | 99.6 | 96.0 | 82 | D2700 |
| Knock value, rich mixture Performance Number | min | 130 | Inherently >130 -D909 test not required--* | | D 909 |
| AON = MON + 0.37 × (RON − MON) | | N/A | 100.5 | N/A | D2700 (MON) & D2699 (RON) |
| Lead | | See spec | None Added | None Added | |
| Density at 15° C., kg/m$^3$ (reported, but not a spec limit) | | | | | D1298 or D4052 |
| Typical values (lb/US Gal): | | 5.85-6.0 | 6.15-6.35 | ~ 5.85-6.0 | |
| Distillation | | | | | D86 |
| Initial boiling point, ° C. | | Report | Report | Report | |
| Fuel Evaporated | | | | | |
| 5 volume % at ° C. | Max | NA | 70 | NA | |
| 10 volume % at ° C. | max | 75 | 85 | 70 | |
| 40 volume % at ° C. | min | 75 | 75 | — | |
| 50 volume % at ° C. | max | 105 | 120 | 121 | |
| 90 volume % at ° C. | max | 135 | 175 | 190 | |
| Final boiling point, ° C. | max | 170 | 220 | 225 | |
| Sum of 10% + 50% evaporated temperatures, ° C. | min | 135 | 135 | — | |
| Recovery volume % | min | 97 | 96 | 95 | |
| Residue volume % | max | 1.5 | 1.5 | — | |
| Loss volume % | max | 1.5 | 2.5 | 3.0 | |
| Vapor pressure 38° C., kPa | min | 38 | 38 | 38 | D323, D5190, or D5191 |
| | max | 49 | 49 | 62 | |
| Freezing point, ° C. | max | −58 | −58** | −78 | D2386 |
| Sulfur, mass % | max | 0.05 | 0.05 | 0.07 | D2622 |
| Net heat of combustion, MJ/kg | min | 43.5 | 41.7 | 40.9 | D4529 or D3338 |
| Corrosion, copper strip, 2 h at 100° C. | max | No. 1 | NA*** | No. 1 | D130 |
| Oxidation stability (5 h aging) | | | | | |
| Potential gum, mg/100 mL | max | 6 | NA | 6 | D873 |
| Induction Time (minutes) | min | NA | 300 | NA | D525**** |
| Water reaction | | | | | D1094 |
| Volume change, mL | max | ±2 | ±2 | NA | |
| Electrical conductivity, pS/m | max | 450 | 450 | | D2624 |

*Supercharge test (D909) is not required, as the compositional requirements insure a D909 result >130 (the existing minimum value for 100 LL).

**If sample fails the standard D910 footnote H requirement for no crystal formation when fuel temperature reduced below −58, then retest after addition of Di-EGME as specified in ASTM D910, paragraph 6.3.2.2. If sample passes with Di-EGME as described, then sample passes freeze point testing. Note operating limitations may require Di-EGME when ambient operating environment may be <−20° C.

***Copper strip testing per antiquated D130 test for Sulphur produces false positives due to fuel chemistry. D2622 measures Sulphur directly.

****Testing demonstrates that the ASTM D873 test methodology, when used with G100UL or xG100UL, produces false positive values for reaction products that are not "gum" (no oxygen present), and which products are merely reaction artifacts of the high temperature at which the test is conducted. Therefore, the alternative test method (D525) is used.

Various unleaded high octane alkylates suitable for aviation gasoline, and various sources of other constituents, may be suitable to provide the novel unleaded aviation fuel blends and the accompanying results described herein. Various dialkylated or trialkylated benzenes may be included in the novel unleaded fuel blends described herein. With respect to dialkylated benzenes, such constituents occur in, and may be provided by way of, commercial xylol mixtures. Such commercial xylol mixtures may slightly vary in composition, but typical specifications are set forth in TABLE 3, and are as follows:

TABLE 3

| Constituent | Supplier 1 % by Weight | Supplier 2 % by Weight |
|---|---|---|
| ethyl benzene | 12.4 | 13.2 |
| m-xylene | 43.4 | 43.7 |

TABLE 3-continued

| Constituent | Supplier 1 % by Weight | Supplier 2 % by Weight |
|---|---|---|
| o-xylene | 24.7 | 23.1 |
| p-xylene | 18.6 | 19.5 |

Such commercial xylol mixtures may be enhanced by use of additional meta-xylene or para-xylene, or both in combination as the available market and economics provide opportunities for the use of those octane enhancing components.

In developing blends according to the various examples mentioned herein, or as may be developed according to the broader teachings herein, useful novel unleaded fuel blends may include, as a significant constituent thereof, certain di-alkylated and/or tri-alkylated benzenes wherein the methyl groups are in the meta relationship. Thus, m-xylene, or 1,3,5-trimethylbenzene may be particularly useful in providing the desired detonation performance.

Many of the components for formulation of an unleaded aviation gasoline are widely available. For example, high octane alkylate is available from various refineries and chemical companies, and suitable for use in various embodiments of an aviation fuel blend as taught herein. More particularly, variations on the motor octane number (MON) of the high octane alkylate are anticipated to be workable. For example, in an embodiment, a ninety-seven (97) MON unleaded base fuel is expected to be workable in some cases, by blending an effective amount the remaining constituents as discussed herein, and in the ranges described, to provide an unleaded aviation gasoline fuel blend meeting the performance objectives as set forth and claimed herein. In special cases, a high octane unleaded aviation gasoline fuel blend may be provided by using a high octane alkylate that has a motor octane number of from ninety five (95) and about one hundred (100). In various embodiments, a high octane unleaded aviation gasoline fuel blend may be more preferably provided by using a high octane alkylate that has a motor octane number of between about ninety-seven (97) and about one hundred (100). In various embodiments, a high octane unleaded aviation gasoline may be provided by utilizing a high octane alkylate that has a motor octane number (MON) of at least ninety-seven point five (97.5). In various embodiments, a high octane unleaded aviation gasoline fuel blend may be provided by using a high octane alkylate that has a motor octane number of between ninety-eight (98) and ninety-nine point nine (99.9). In various embodiments, a high octane unleaded aviation gasoline fuel blend may be more easily provided by using a high octane alkylate that has a motor octane number of between about ninety-eight (98) and about one hundred (100). In various embodiments, a high octane unleaded aviation gasoline fuel blend may be easily provided by using a high octane alkylate that consists essentially of iso-octane. In an embodiment, a high octane unleaded aviation gasoline fuel blend may be provided by using a high octane alkylate that consists of commercial grade iso-octane.

In the various examples as described, toluene (methylbenzene) may be utilized as one of the one or more additional alkylated benzenes. As further discussed below, some of the constituents, and in particular, N-methyl-p-toluidine, are essentially commercially unknown in fuel formulations at this time. Thus, in order to commercialize some embodiments of the fuels described herein, availability of such constituents may need to be assured before some embodiments of the formulations described and claimed herein may be placed into widespread usage.

In any event, a novel, useful high octane unleaded aviation gasoline composition has been developed. In an embodiment, a suitable blend may include:

(a) about forty-five percent (45%) to about sixty-five percent (65%) by weight of at least one high octane alkylate, wherein the unleaded high octane alkylate has a motor octane number (MON) of between ninety-seven (97) and ninety-nine point nine (99.9);

(b) about ten percent (10%) to about thirty-five percent (35%) by weight of one or more alkalyated benzenes;

(c) about six percent (6%) to about twelve percent (12%) by weight, collectively, of a selected composition of one or more of iso-pentane, n-butane, and iso-butane, wherein the constituent(s) of said selected composition are sufficient that said high octane unleaded aviation gasoline composition has a vapor pressure of between 38 kPa and 49 kPa (between 5.51 pounds per square inch and 7.11 pounds per square inch); and (d) about four percent (4%) to about fifteen percent (15%) by weight aromatic amine(s), wherein the aromatic amine(s) include the use of N-methyl-p-toluidine.

In an embodiment, a suitable high octane unleaded aviation gasoline may further include the use of N-methyl-m-toluidine. In various embodiments, the aromatic amine(s) may further, or in lieu of N-methyl-m-toluidine, include the use of m-toluidine. In an embodiment, a high octane unleaded aviation gasoline may include both N-methyl-p-toluidine and N-methyl-m-toluidine. In an embodiment, the N-methyl-p-toluidine and N-methyl-m-toluidine may be present at the ratio of between about four to one (4:1) and twelve to one (12:1), by weight. In an embodiment, the N-methyl-p-toluidine and N-methyl-m-toluidine may be present at the ratio of between about six to one (6:1) and ten to one (10:1), by weight. In order to consume both N-methyl-p-toluidine and either m-toluidine or N-methyl-m-toluidine at the ratio at which their precursors, namely p-toluidine and m-toluidine are produced during various processes for the production of o-toluidine, a high octane unleaded aviation gasoline may be produced wherein N-methyl-p-toluidine and the N-methyl-m-toluidine are present at the ratio from about four to one (4:1) to about ten to one (10:1). In an embodiment, the N-methyl-p-toluidine and the m-toluidine or N-methyl-m-toluidine may be present at the ratio of about thirty-six to four (36:4), by weight. The actual ratio may, in an embodiment, be selected to reflect the utilization of these two compounds at a ratio consistent with the proportion of the production of their precursor molecules.

In yet another embodiment, N-methyl-p-toluidine and m-toluidine may be both provided, at the ratio of between about four to one (4:1) and about twelve to one (12:1), by weight. In an embodiment, in addition to N-methyl-p-toluidine, the high octane unleaded aviation gasoline may further include both N-methyl-m-toluidine and m-toluidine. In an embodiment, (a) the weight of the N-methyl-p-toluidine, and (b) the combined weight of the N-methyl-m-toluidine and the m-toluidine, may be present at the ratio of between about four to one (4:1) and about nine to one (9:1).

More generally, a high octane unleaded aviation gasoline blend may be provided wherein the aromatic amine(s) are present at between about eight percent (8%) and about fifteen percent (15%) by weight of the high octane unleaded gasoline. In an embodiment, the aromatic amine(s) may be provided at between about nine percent (9%) and about thirteen percent (13%) by weight of the high octane unleaded gasoline. In an embodiment, a high octane unleaded aviation gasoline blend may be provided wherein the aromatic amine(s) are present at between about ten percent (10%) and about twelve percent (12%) by weight of the high octane unleaded gasoline.

In various embodiments, a workable high octane unleaded aviation gasoline fuel blend may be provided using toluene at more than zero percent (0%) to about thirty percent (30%) by weight of the high octane unleaded aviation gasoline. In various embodiments, a high octane unleaded gasoline may include toluene at between about five percent (5%) and about twenty-five percent (25%) by weight of the high octane unleaded aviation gasoline. However, in other embodiments, the high octane unleaded aviation gasoline may be further characterized in that toluene is not specifically added but it may be present in small amounts only due to its existence as part of process streams associated with other components.

In various embodiments, a workable high octane unleaded gasoline may include one or more dialkylated benzenes, wherein the one or more dialkylated benzenes include m-xylene or p-xylene. In various embodiments, the amounts of m-xylene and p-xylene, when alone or together in combination, may amount to no more than thirty percent (30%) by weight of the high octane unleaded gasoline.

In various embodiments, a workable high octane unleaded aviation gasoline may include one or more of iso-pentane, n-butane, and iso-butane. In various embodiments, the amount of iso-pentane, iso-butane, and n-butane may be in a selected composition having total weight percent sufficient that five percent (5%) by volume of the high octane unleaded aviation gasoline evaporates at a maximum of seventy degrees Celsius (70° C.). In an embodiment, the amount of iso-pentane, iso-butane, and n-butane may be in a selected composition having total weight percent sufficient that five percent (5%) by volume of the high octane unleaded aviation gasoline evaporates at a maximum of seventy-five degrees Celsius (75° C.). an embodiment, the amount of iso-pentane, iso-butane, and n-butane may be in a selected composition having total weight percent sufficient that ten percent (10%) by volume of the high octane unleaded aviation gasoline evaporates at a maximum of eighty degrees Celsius (80° C.). In an embodiment, the amount of iso-pentane, iso-butane, and n-butane may be in a selected composition having total weight percent sufficient that ten percent (10%) by volume of the high octane unleaded aviation gasoline evaporates at a maximum of eighty-five degrees Celsius (85° C.).

In various embodiments, a workable high octane unleaded aviation gasoline may be further characterized by the absence of metallic compounds possessing octane enhancing or anti-knock properties.

In various embodiments, constituents utilized in a high octane unleaded aviation gasoline blend may include aromatic amine(s) that are provided (1) to reflect the stoichiometry of the production of their precursors and the market demand for o-toluidine, and/or (2) reaction product compositions made from such, products, and wherein the reaction product compositions comprise primarily (i) N-methyl-p-toluidine or (ii) N-methyl-m-toluidine, or both.

In various embodiments, a high octane unleaded aviation gasoline blend may have a detonation performance, as Aviation Octane Number, of at least ninety-nine point nine (99.9). In various embodiments, a high octane unleaded aviation gasoline blend may have a detonation performance, as Aviation Octane Number, of at least one hundred point five (100.5). In various embodiments, a high octane unleaded aviation gasoline blend may have a detonation performance, as Aviation Octane Number, of at least one hundred and one point five (101.5).

In various embodiments, high octane unleaded aviation gasoline blend may be provided having a freezing point at or below minus fifty degrees Celsius (−50° C.). In various embodiments, high octane unleaded aviation gasoline blend may have a freezing point at or below minus fifty-eight degrees Celsius (−58° C.). Also, PRIST® brand anti-icing fluid (sold by Nexeo Solutions, LLC, of 3 Waterway Square Place, Suite 1000, The Woodlands, Tex. 77380, see:http://www.nexeosolutions.com/market-industry/chemicals/military-commercial-aircraft/), also known generically as diethylene glycol monomethyl ether (DEGMME) in amounts consistent with existing industry usage for aviation gasolines may be used in various embodiments to ensure the high octane unleaded aviation gasoline blend will routinely pass standard laboratory testing for aviation gasolines as described in the current ASTM D910 specification. In an embodiment, anhydrous isopropyl alcohol may also be used, and used in amounts consistent with those amounts currently authorized for use in aviation gasoline by the ASTM D910 specification. In an embodiment it may be desirable to include operating instructions for the aircraft that require the addition of PRIST (or anhydrous isopropyl alcohol) if the ambient temperature is below minus twenty degrees Celsius (−20° C.). In an embodiment it may be desirable to include operating instructions for the aircraft that require the addition of PRIST (or anhydrous isopropyl alcohol) if the ambient temperature is below minus thirty degrees Celsius (−30° C.). In an embodiment it may be desirable to include operating instructions for the aircraft that require the addition of PRIST (or anhydrous isopropyl alcohol) if the ambient temperature is below minus forty degrees Celsius (−40° C.).

In another aspect of the invention, a method for operating a spark ignition piston driven aircraft engine is provided. Such methods involve operating the aircraft engine with the high octane unleaded aviation fuel composition as set forth herein.

In yet another embodiment, using an existing aircraft engine mechanically designed for use by combustion of a fuel having ninety-nine point six (99.6) motor octane number (MON) or better leaded aviation gasoline, where the engine utilizes a spark ignition system with pistons in cylinders, a method is provided for drop-in substitution of leaded aviation gasoline with an unleaded aviation gasoline fuel blend, where the unleaded aviation fuel blend includes (a) an aviation gasoline base fuel, as described above, (b) a selected amount of one or more alkylated, di-alkylated, or tri-alkylated benzenes, and (c) a selected amount of N-methyl-p-toluidine.

Evaluation of the detonation performance properties of various fuel mixtures as described herein may be carried out by methods known to those of skill in the art and to whom this specification is directed, using known methods. For example, attention is drawn to the various FAA reports first noted above, where, for example, the DOT/FAA/AR-TN07/5 report of March 2007, where description is made of the testing of detonation performance of various fuels. Attention is also drawn to ASTM Standard D2700, entitled "Test Method for Detonation Characteristics of Motor and Aviation Fuels by the Motor Method," which is the test method indicated for use for determination of knock value, lean mixture octane number, under ASTM Standard D910-11. ASTM Standard D2699 the Standard Test Method for Research Octane Number (RON) of Spark-Ignition Engine Fuel. Attention is also drawn to ASTM Standard D909, entitled "Standard Test Method for Supercharge Rating of Spark-Ignition Aviation Gasoline" as that method while applicable for certain tests required under the ASTM Standard D910-11 just referred to above may not be necessary to qualify the proposed high octane unleaded aviation gasoline.

Various methods are known for manufacture of 1,3,5-trimethylbenzene (also known as mesitylene). Such methods include the following: U.S. Pat. No. 5,087,781 entitled Method of Making Mesitylene, describes the use of a niobium catalyst for vapor phase reaction of acetone. U.S. Pat. No. 3,267,165, entitled Preparation of Mesitylene by Dehydrocondensation of Acetone, describes the reaction of acetone with sulfuric acid and polyphosphoric acid, and recovery of mesitylene by steam distillation. U.S. Pat. No. 2,917,561 entitled Production of Mesitylene, describes the use of a vapor phase reaction using a catalyst. Swift Enterprises, Inc, assignee of US Patent Application Publication No. 2008/0244961 A1, published on Oct. 9, 2008, reveals a biological derived material method for production of Mesitylene.

In the foregoing description, for purposes of explanation, numerous details have been set forth in order to provide a thorough understanding of the disclosed exemplary embodiments for the formulation of aviation fuel blends. For clarity, amine compounds used in the formulations set forth herein would be included under proportions providing aromatic amines, and not in the proportions providing alkylated benzenes, even if such molecule includes both aromatic and alkylated moieties. Further, for descriptive purposes, various relative terms such as "about" may be used. Although those of skill in the art will understand the sensitivity of stated limits as compared to the term "about" (which may in some case necessarily be more strict), as applied to the data herein the term may generally include in such range up to and including ten percent (10%) from a stated upper boundary value and down to and including ten percent (10%) from a stated lower boundary value. Terms that are relative only to a point of reference are not meant to be interpreted as absolute limitations, but are instead included in the foregoing description to facilitate understanding of the various aspects of the disclosed embodiments. And, various actions or activities in a method described herein may have been described as multiple discrete activities, in turn, in a manner that is most helpful in understanding the present invention. However, the order of description should not be construed as to imply that such activities are necessarily order dependent. In particular, certain mixing or blending operations may not necessarily need to be performed in the order of presentation. And, in different embodiments of the invention, one or more activities may be performed simultaneously, rather than sequentially. Also, the reader will note that the phrase "in an embodiment" or "in one embodiment" has been used repeatedly. This phrase generally does not refer to the same embodiment; however, it may. Finally, the terms "comprising", "having" and "including" should be considered synonymous, unless the context dictates otherwise.

Further, it should be understood by those of skill in the art and to whom this specification is directed that the term "aircraft" has been used herein consistent with US Federal Aviation Administration regulations to mean a device that is used or intended to be used for flight in the air. Under the same regulations and as used herein, the term "rotorcraft" means a heavier-than-air aircraft that depends principally for its support in flight on the lift generated by one or more rotors. Similarly, under the same regulations and as used herein, the term "helicopter" means a rotorcraft that, for its horizontal motion, depends principally on its engine-driven rotors. Finally, under the same regulations and as used herein, an "aircraft engine" means an engine that is used or is intended to be used for propelling aircraft. Appurtenances and accessories, and air compressors such as turbochargers, are normally considered by those of skill in the art, and under applicable FAA regulations, as components of the aircraft engines with respect to which they are operably connected. Thus, the unleaded fuel blends described and claimed herein should be considered as useful for such piston driven "aircraft engines".

Importantly, the aspects and embodiments described and claimed herein may be modified from those shown without materially departing from the novel teachings and advantages provided by this invention, and may be embodied in other specific forms without departing from the spirit or essential characteristics thereof. Therefore, the embodiments presented herein are to be considered in all respects as illustrative and not restrictive or limiting. As such, this disclosure is intended to cover the formulations and blends described herein and the legal equivalents thereof. Numerous modifications and variations are possible in light of the above teachings. Therefore, the protection afforded to this invention should be limited only by the claims set forth herein, and the legal equivalents thereof.

The invention claimed is:

1. A method for manufacture of a high octane unleaded aviation fuel composition, comprising:

(a) providing about forty-five percent (45%) to about sixty-five percent (65%) by weight of high octane alkylate having a motor octane number of between ninety-five (95) and one hundred (100);

(b) providing about ten percent (10%) to about thirty-five percent (35%) by weight of one or more alkylated benzenes;

(c) providing about six percent (6%) to about twelve percent (12%) by weight, collectively, of a selected composition of one or more of iso-pentane, n-butane, and iso-butane, wherein the constituent(s) of said selected composition are sufficient that said high octane unleaded aviation gasoline composition has a vapor pressure of between 38 kPa and 49 kPa (between 5.8 pounds per square inch and 7.2 pounds per square inch);

(d) providing about four percent (4%) to about fifteen percent (15%) by weight aromatic amine(s), said aromatic amine(s) comprising N-methyl-p-toluidine and N-methyl-m-toluidine in the ratio of between about four to one (4:1) and about twelve to one (12:1), by weight;

(e) wherein said N-methyl-p-toluidine and said N-methyl-m-toluidine provided in (d) are byproducts of production of o-toluidine, said byproducts comprising m-toluidine and p-toluidine, and wherein said m-toluidine and said p-toluidine are reacted with a selected source of methyl groups to produce N-methyl-p-toluidine and (ii) N-methyl-m-toluidine; and (f) blending each of the compositions provided in (a), (b), (c), and (d) above to provide a high octane unleaded aviation fuel composition.

2. The method as set forth in claim 1, wherein said method further comprises providing (a) said N-methyl-p-toluidine and (b) said N-methyl-m-toluidine at the ratio of between about six to one (6:1) and about ten to one (10:1), by weight.

3. The method as set forth in claim 1, wherein said method comprises providing (a) said N-methyl-p-toluidine and (b) said N-methyl-m-toluidine at the ratio of about thirty six to four (36:4), by weight.

4. The method as set forth in claim 1, wherein said method further comprises providing m-toluidine, and blending said m-toluidine with compositions provided in (a), (b), (c), and (d) of claim 1 to provide a high octane unleaded aviation fuel composition.

5. The method as set forth in claim 1, wherein providing said selected composition of one or more of iso-pentane, n-butane, and iso-butane consists of providing a selected composition having total weight percent in an amount sufficient that five percent (5%) by volume of the high octane unleaded aviation gasoline evaporates at a maximum of seventy five degrees Celsius (70° C.).

6. The method as set forth in claim 1, wherein providing said selected composition of one or more of iso-pentane, n-butane, and iso-butane consists of providing a selected composition having total weight percent in an amount sufficient that ten percent (10%) by volume of the high octane unleaded aviation gasoline evaporates at a maximum of seventy five degrees Celsius (75° C.).

7. The method as set forth in claim 1, wherein providing said selected composition of one or more of iso-pentane, n-butane, and iso-butane consists of providing a selected composition having total weight percent in an amount sufficient that ten percent (10%) by volume of the high octane unleaded aviation gasoline evaporates at a maximum of eighty degrees Celsius (80° C.).

8. The method as set forth in claim 1, wherein providing said selected composition of one or more of iso-pentane, n-butane, and iso-butane consists of providing a selected composition having total weight percent in an amount sufficient that ten percent (10%) by volume of the high octane unleaded aviation gasoline evaporates at a maximum of eighty-five degrees Celsius (85° C.).

9. The method as set forth in claim 1, wherein a selected weight percent of each of said constituents provides a high octane unleaded aviation gasoline with a freezing point at or below minus fifty degrees Celsius (−50° C.).

10. The method as set forth in claim 1, wherein a selected weight percent of each of said constituents provides a high octane unleaded aviation gasoline with a freezing point at or below minus fifty eight degrees Celsius (−58° C.).

11. The method as set forth in claim 9, further comprising adding a commercially acceptable amount of diethylene glycol monomethyl ether (DEGMME) to said composition.

12. The method as set forth in claim 9, further comprising adding a commercially acceptable amount of anhydrous isopropyl alcohol to said composition.

13. The method as set forth in claim 1, wherein said at least one high octane alkylate has a motor octane number of between ninety-seven (97) and ninety-nine point nine (99.9), inclusive.

14. The method as set forth in claim 1, wherein said at least one high octane alkylate has a motor octane number of between ninety seven (97) and one hundred (100), inclusive.

15. The method as set forth in claim 1, wherein said at least one high octane alkylate has a motor octane number of between ninety-eight (98) and one hundred (100), inclusive.

16. The method as set forth in claim 1, wherein said at least one high octane alkylate has a motor octane number of about 100.

17. The method as set forth in claim 1, wherein said at least one high octane alkylate consists essentially of iso-octane.

18. The method as set forth in claim 1, wherein said at least one high octane alkylate consists of commercial grade iso-octane.

19. The method as set forth in claim 1, wherein said one or more alkylated benzenes comprises monoalkylated benzenes.

20. The method as set forth in claim 1, wherein said monoalkylated benzenes comprise toluene.

21. The method as set forth in claim 20, wherein said toluene comprises more than zero percent (0%) to about thirty percent (30%) by weight of said high octane unleaded aviation gasoline.

22. The method as set forth in claim 20, wherein said toluene comprises between about five percent (5%) and about twenty five percent (25%) by weight of said high octane unleaded aviation gasoline.

23. The method as set forth in claim 1, wherein said one or more alkylated benzenes comprises a commercial xylol mixture.

24. The method as set forth in claim 1, wherein said one or more alkylated benzenes comprises dialkylated benzenes.

25. The method as set forth in claim 24, wherein said dialkylated benzenes comprise m-xylene or p-xylene, and wherein said m-xylene and said p-xylene, when alone or together in combination, comprise no more than thirty-five percent (35%) by weight of said high octane unleaded aviation gasoline.

26. The method as set forth in claim 24, wherein said dialkylated benzenes comprise between about fifteen percent (15%) and about thirty percent (30%) of said high octane unleaded aviation gasoline by weight.

27. The method as set forth in claim 1, wherein said one or more alkylated benzenes comprises trialkylated benzenes.

28. The method as set forth in claim 27, wherein said trialkylated benzenes comprises 1,3,5-trimethylbenzene.

29. The method as set forth in claim 1, wherein said aromatic amine(s) further comprise N-methyl-m-toluidine and m-toluidine, and wherein (a) the weight of said N-methyl-p-toluidine, and (b) the combined weight of said N-methyl-m-toluidine and said m-toluidine, are present at the ratio of between about four to one (4:1) and about twelve to one (12:1).

30. The method as set forth in claim 1, wherein said aromatic amine(s) comprise between about six percent (6%) and about fifteen percent (15%) by weight of said high octane unleaded gasoline.

31. The method as set forth in claim 1, wherein said aromatic amine(s) comprise between about nine percent (9%) and about thirteen percent (13%) by weight of said high octane unleaded gasoline.

32. The method as set forth in claim 1, wherein said aromatic amine(s) comprise between about ten percent (10%) and about twelve percent (12%) by weight of said high octane unleaded gasoline.

33. The method as set forth in claim 5, or in claim 6, wherein said iso-pentane is provided in an amount of between about four percent (4%) and about twelve percent (12%) by weight, inclusive.

34. The method as set forth in claim 5, or in claim 6, wherein said n-butane is provided in an amount between more than zero percent (0%) and about three point five percent (3.5%) by weight, inclusive.

35. The method as set forth in claim 5, or in claim 6, wherein said iso-butane is provided in an amount between more than zero percent (0%) and about three point five percent (3.5%) by weight, inclusive.

36. The method as set forth in claim 1, comprising selecting a composition in each of steps (a), (b), (c), and (d) of claim one that, when blended together, provide a high octane unleaded aviation gasoline effective to provide full scale aircraft engine detonation performance of said high octane unleaded aviation gasoline at an aviation octane number of at least ninety-nine point nine (99.9).

37. The method as set forth in claim 1, comprising selecting a composition in each of steps (a), (b), (c), and (d) of claim one that, when blended together, provide a high octane unleaded aviation gasoline effective to provide detonation performance of said high octane unleaded aviation gasoline at an aviation octane number of at least one hundred point five (100.5).

38. The method as set forth in claim 1, comprising selecting a composition in each of steps (a), (b), (c), and (d) of claim one that, when blended together, provide a high octane unleaded aviation gasoline effective to provide detonation performance of said high octane unleaded aviation gasoline at an aviation octane number of at least one hundred one point five (101.5).

39. A method for operating a spark ignition piston driven aircraft engine, said method comprising operating the aircraft engine with the unleaded aviation fuel composition of made by the method of claim 1.

* * * * *